US012440887B2

(12) United States Patent
Wang et al.

(10) Patent No.: US 12,440,887 B2
(45) Date of Patent: Oct. 14, 2025

(54) PRESSING DIE FOR AN UNCURLED SHELL OF A PRESSURE-RESISTANT EASY OPEN END

(71) Applicant: SUZHOU SLAC PRECISION EQUIPMENT CO., LTD, Jiangsu (CN)

(72) Inventors: Bingsheng Wang, Suzhou (CN); Weiwei Zhang, Suzhou (CN); Kang Xiong, Suzhou (CN)

(73) Assignee: SUZHOU SLAC PRECISION EQUIPMENT CO., LTD, Suzhou (CN)

( * ) Notice: Subject to any disclaimer, the term of this patent is extended or adjusted under 35 U.S.C. 154(b) by 193 days.

(21) Appl. No.: 18/033,162

(22) PCT Filed: Oct. 21, 2021

(86) PCT No.: PCT/CN2021/125312
§ 371 (c)(1),
(2) Date: Apr. 21, 2023

(87) PCT Pub. No.: WO2022/083692
PCT Pub. Date: Apr. 28, 2022

(65) Prior Publication Data

US 2023/0286031 A1 Sep. 14, 2023

(30) Foreign Application Priority Data

Oct. 21, 2020 (CN) ..... 202011129707.4

(51) Int. Cl.

| | |
|---|---|
| ***B21D 37/10*** | (2006.01) |
| ***B21D 22/22*** | (2006.01) |
| ***B21D 22/24*** | (2006.01) |
| ***B21D 37/08*** | (2006.01) |
| ***B21D 51/44*** | (2006.01) |

(52) U.S. Cl.
CPC ..... *B21D 37/10* (2013.01)

(58) Field of Classification Search
CPC ..... B21D 37/10; B21D 37/08; B21D 22/22; B21D 22/24; B21D 51/44
See application file for complete search history.

(56) References Cited

U.S. PATENT DOCUMENTS

2010/0089116 A1* 4/2010 Stodd ..... B21D 22/24 413/69
2016/0016224 A1* 1/2016 Turner ..... B21D 51/383 72/349

* cited by examiner

*Primary Examiner* — Mohammed S. Alawadi
(74) *Attorney, Agent, or Firm* — Oliff PLC

(57) ABSTRACT

A pressing die for an uncurled shell of a pressure-resistant easy open end, and the lower die mainly consists of a lower die base, a lower die core ring, a lower die core, a lower pressing ring and a lower blade; the upper die mainly consists of an upper die base, an upper die core, an upper inner forming ring, an upper outer forming ring and an upper blade, wherein: for the new easy open end type, the top of the lower die core ring of the lower die was designed to be the contour matching the new can end type, and the upper outer forming ring and the upper inner forming ring of the upper die were designed to the contour and suspended portion matching the lower die core ring of the lower die.

1 Claim, 17 Drawing Sheets

PRESSING DIE FOR AN UNCURLED SHELL OF A PRESSURE-RESISTANT EASY OPEN END

TECHNICAL FIELD

The present invention relates to a stamping die for an easy open can, in particular to a stamping die for an uncurled shell of an easy open end used on a punch (press).

The so-called uncurled shell, commonly known as a "bare shell", refers to a shell whose overall shape has been formed but has not yet been scribed or installed with a pull ring.

BACKGROUND OF INVENTION

With the improvement of people's living standards, easy open cans are used more and more in the field of food and beverage, especially in beer and beverage packaging.

The ring-pull can consists of two parts: the can body and the easy open end. The metal sheet is usually pressed into an uncurled shall (bare shell) through a die first, and then the uncurled shell is scribed and installed with a pull ring to finally form a finished easy open end.

Among them, the forming and manufacturing of uncurled shells is the core of the production of easy open ends. Therefore, for manufacturers of easy open ends, the key to ensuring product output and quality is the type of pressing dies for uncurled shells of easy open ends.

For positive pressure type easy open cans (bearing positive pressure of gas inside), although the uncurled shell of the easy open end is only a cover, it is necessary to carry out complex and special design on its cross-sectional shape and structure in order to improve its pressure bearing capacity (pressure resistance).

The structure of the uncurled shell of the newly developed pressure-resistant easy open end is shown in FIG. 1.

On the cross section of the uncurled shell, it consists of a sealing portion, a countersink portion, a ferrule arc portion, an upward extension portion of ferrule and a center panel from periphery to center, and an annular recess is formed between the countersink portion and the upward extension portion of ferrule.

It is necessary to design a corresponding pressing die in order to press out the uncurled shell of the easy open end.

On Apr. 29, 2015, the Chinese patent CN102176989B (hereinafter referred to as "Comparative Patent 1") announced and authorized an invention patent entitled "Method and Equipment for Forming Can Shells", with the patent number of 200980140308.3.

The patent disclosed a kind of pressing die for the uncurled shell of the easy open end, but in general: first, the design of the pressing die structure is complex, especially the complex design of the pneumatic route in the die, high production difficulty and high cost; second, the type of the uncurled shell of the easy open end pressed by it is different.

On May 30, 2012, the Chinese patent CN202239263U (hereinafter referred to as "Comparative Patent 1") announced and authorized a utility model patent entitled "A pressing die for an uncurled shell of a pressure-resistant easy open end", with the patent number of 201120355905.2.

This patent is the prior art which is closest to the present case and also the prior patent technology owned by the applicant of the present case.

The can end type of the uncurled shell of the easy open end changed, and the pressing die used for the uncurled shell of the easy open end showed some shortcomings in the practical application, such as the action surface of the upper pressing ring is easy to wear, the part of the uncurled shell corresponding to the upper pressing ring is prone to be thinned during the stretching forming and the flange of the upper die core body is easy to crack, etc.

Thus, the reliability and service life of the pressing die for the uncurled shell of the easy open end during the production process are adversely affected.

In view of this, it's the subject of the present invention to improve the original pressing die for the uncurled shell of the easy open end and overcome the above shortcomings on the basis of adapting to the uncurled shell of the new easy open end type.

DISCLOSURE OF THE INVENTION

The present invention provides a pressing die for an uncurled shell of a pressure-resistant easy open end, which aims to solve the reliability and service life problems of the original pressing die for the uncurled shell of the easy open end on the basis of adapting to the easy open end type.

In order to achieve the above purpose, the technical solution adopted by the present invention is: a pressing die for an uncurled shell of a pressure-resistant easy open end consists of a lower die and an upper die.

The lower die mainly consists of a lower die base, a lower die core ring, a lower die core, a lower pressing ring and a lower blade, wherein:

The lower die base is a cylinder with an upper opening.

The lower die core ring is an annular body, which is fixed in the lower die base and concentric with the lower die base;

The acting part of the lower die core is a cylindrical body, which is embedded in the lower die core ring and slidably matched with the lower die core ring in the upward and downward directions; a first air chamber is sealed and formed under the lower die core in the lower die core ring, and the air pressure of the first air chamber is used to support the lower die core.

The lower pressing ring is an annular body, which is embedded between the lower die base and the lower die core ring, and a second air chamber is sealed and formed between the lower die base and the lower die core ring and under the lower pressing ring, and the air pressure of the second air chamber is used to support the lower pressing ring.

The lower blade is an annular body, which is fixed on the edge of the upper opening of the lower die base, and a lower cutting edge is provided on the inner edge of the top of the annular body.

The upper die mainly consists of an upper die base, an upper die core, an upper inner forming ring, an upper outer forming ring and an upper blade, wherein:

The upper die base is a cylinder with a lower opening.

The acting part of the upper die core is a cylindrical body, which is arranged in the upper die base and concentric with the upper die base, and the upper die core is slidably matched with the upper die base in the upward and downward directions.

A third air chamber is sealed and formed above the upper die core in the upper die base, and the air pressure of the third air chamber is used to press against the upper die core.

The upper inner forming ring is an annular body, which is embedded between the upper die core and the upper die base, and a fourth air chamber is sealed and formed between the upper die core and the upper die base and above the upper inner forming ring, and the air pressure of the fourth air chamber is used to press against the upper inner forming ring.

The upper outer forming ring is an annular body, which is embedded between the upper die base and the upper inner forming ring, and a fifth air chamber is sealed and formed between the upper die base and the upper inner forming ring and above the upper outer forming ring, and the air pressure of the fifth air chamber is used to press against the upper outer forming ring.

The upper blade is an annular body, which is fixed on the edge of the lower opening of the upper die base, and an upper cutting edge matched with the lower cutting edge is provided on the outer edge of the bottom of the upper blade.

Its innovation is: for the uncurled shell, it consists of a sealing portion, a countersink portion, a ferrule arc portion, an upward extension portion of ferrule and a center panel on the cross section of the uncurled shell from periphery to center, and an annular recess is formed between the countersink portion, the ferrule arc portion and the upward extension portion of ferrule; the sealing portion is formed by a tangent connection of a first straight portion, a first arc portion, a second arc portion, and a third arc portion; the countersink portion is formed by a tangent connection of a second straight portion, a fourth arc portion, a fifth arc portion, a sixth arc portion and a third straight portion; the ferrule arc section is formed of a seventh arc portion; the upward extension portion of ferrule is formed by a tangent connection of a fourth straight line and an eighth arc portion; the center panel is formed by a fifth straight line.

The upper outer forming ring and the upper inner forming ring of the upper die match with the lower die core ring of the lower die up and down, wherein the lower die core ring is provided with a contour on its top corresponding to the first straight portion, the first arc portion, the second arc portion, the third arc portion, the second straight portion, the fourth arc portion, the fifth arc portion, the sixth arc portion and the third straight portion of the uncurled shell.

The upper outer forming ring is provided with a contour on the bottom corresponding to the second arc portion of the uncurled shell, while the parts at the bottom of the upper outer forming ring corresponding to the first arc portion and third arc portion of the uncurled shell are suspended relative to the top of the lower die core ring in a closed state.

The upper inner forming ring is provided with a contour on the bottom corresponding to the fourth arc portion and the fifth arc portion of the uncurled shell, while the parts at the bottom of the upper inner forming ring corresponding to the second straight portion, the sixth arc portion and third straight portion of the uncurled shell are suspended relative to the top of the lower die core ring in a closed state.

The upper die core of the upper die matches with the lower die core of the lower die up and down, wherein the lower die core is provided with a contour on its top corresponding to the seventh arc portion, the fourth straight portion, the eighth arc portion and the fifth straight portion of the uncurled shell.

The upper die core is provided with a contour on its bottom corresponding to the fifth straight portion of the uncurled shell.

The above-described technical solution is explained as follows:

1. In above-described technical solution, the parts at the bottom of the upper die core corresponding to the seventh arc portion, the fourth straight portion and the eighth arc portion of the uncurled shell are suspended relative to the top of the lower die core in a closed state, thereby forming a non-preformed pressing die.

2. In above-described technical solution, the upper die core is provided with a contour on its bottom corresponding to the eighth arc portion of the uncurled shell, while the parts at the bottom of the upper die core (13) corresponding to the seventh arc portion and the fourth straight portion of the uncurled shell are suspended relative to the top of the lower die core in a closed state, thereby forming a preformed pressing die.

The design principle and concept of the present invention are: In order to adapt to the new can end type and solve the reliability and service life problems of the pressing die for the uncurled shell of the easy open end during use, the following improvement measures were mainly adopted in the present invention: first, the top of the lower die core ring of the lower die was designed to be the contour matching the new can end type, and the upper outer forming ring and the upper inner forming ring of the upper die were designed to the contour and suspended portion matching the lower die core ring of the lower die; second, the second blocking face in Comparative Patent 2 (i.e., the second blocking face referred to in the No. 34 in FIG. 2 of Comparative Patent 2) was canceled; third, the avoidance space between the lower die core and the top of the lower die core ring in Comparative Patent 2 (i.e., the "avoidance space 11" recorded in the last line of paragraph [0020] of the specification in Comparative Patent 2) was improved to be that the lower die core is provided with a contour at the edge of its top corresponding to the seventh arc portion, the fourth straight portion, the eighth arc portion and the fifth straight portion of the new can end type.

Due to the application of the above-described technical solution, the present invention has the following advantages and effect in comparison with the prior art:

1. Compared with Comparative Patent 2, the design of the die structure for the uncurled shell of the easy open end has obvious advantages.

In Comparative Patent 2 (see the specification and figures of the Comparative Patent), the seaming portion 41, the upper transition arc 46, and the upper countersink portion 47 of the uncurled shell of the easy open end are formed by the joint action of the annular bevel of the bottom end face of the upper forming ring 32 and the bottom end face of the upper pressing ring 14.

During the forming process, the second blocking limit face facing downward provided at the periphery of the upper forming ring 32 and matching with the top of the upper pressing ring 14 is used to ensure that the annular bevel of the bottom end face of the upper forming ring 32 and the bottom end face of the upper pressing ring 14 accurately maintain a fixed drop.

At the fixed drop, the contour of the annular bevel of the bottom end face of the upper forming ring 32 and the bottom end face of the upper pressing ring 14 matches with the contour of the seaming portion 41, the upper transition arc 46, and the upper countersink portion 47 of the uncurled shell of the easy open end, thereby ensuring the stability of the contour of the seaming portion 41, the upper transition arc 46, and the upper countersink portion 47 of the uncurled shell of the easy open end.

For the upper forming ring 32 and the upper pressing ring 14 of this structure, not only the accuracy of the annular bevel of the bottom end face of the upper forming ring 32 and the bottom end face of the upper pressing ring 14 shall be ensured, but also the relative accuracy between the annular bevel of the bottom end face of the upper forming ring 32 and the bottom end face of the upper pressing ring 14 shall be ensured, which increases the difficulty of processing and manufacturing, and after a period of operation of the pressing die for the uncurled shell of the easy open end, the annular bevel of the bottom end face of the upper forming ring 32 and the bottom end face of the upper pressing ring 14 will have different degrees of surface wear, so the initial drop between the annular bevel of the bottom end face of the upper forming ring 32 and the bottom end face of the upper pressing ring 14 can't be maintained at this time.

Meanwhile, the air spring force acting on the upper forming ring 32 will be transmitted to the upper pressing ring 14 through the second blocking limit face facing downward provided at the periphery of the upper forming ring 32 and matching with the top of the upper pressing ring 14, causing excessive force acting on the upper pressing ring 14, to result in increased surface wear on the bottom end face of the upper pressing ring 14.

The structure of the pressing die design for the uncurled shell of the easy open end of the present invention solved this problem very well.

2. Compared with Comparative Patent 2, the die forming principle of the uncurled shell of the easy open end is more advanced.

In Comparative Patent 2 (see the specification and figures of the Comparative Patent), the ferrule arc portion 42 and the upward extension portion of ferrule 43 of the uncurled shell of the easy open end are formed through the flange 16 on the upper die core 13 and the avoidance space 11 for the forming of ferrule on the lower die 2.

During the entire process of forming the ferrule, the blank will be blocked by the flange 16 on the upper die core 13, resulting in the thinning of the blanket of the ferrule arc portion 42 and upward extension portion of ferrule 43 of the uncurled shell of the easy open end, which affects the performance of the uncurled shell of the easy open end, and the R angular radius of the flange 16 on the upper die core 13 must be greater than or equal to 0.4 mm, that is, the R angular radius of the ferrule arc portion of the uncurled shell 42 must be greater than or equal to 0.4 mm.

If it is less than 0.4 mm, the blank will directly crack during the forming of the ferrule.

At the same time, the wall thickness of the flange 16 on the upper die core 13 is very thin. During the operation of the die for the uncurled shell of the easy open end, the flange 16 on the upper die core 13 is prone to fracture, so the service life of the upper die core body 20 is low.

In the present invention (see the figures of the present invention), the seventh circular arc portion R7 (ferrule arc portion) and the fourth straight portion L4 of the uncurled shell of the easy open end are formed by naturally bending.

During the forming process, the annular recess 11 on the outer side of the top end face of the lower die core 5 is served as the function of supporting and limiting.

The blank of the seventh arc portion R7 (ferrule arc portion) and the fourth linear portion L4 of the uncurled shell produced by the die of the present invention will not become thinner, so the performance of the uncurled shell produced by the die of the easy open end of the present invention is better, that is, the pressure resistance of the uncurled shell is higher.

At the same time, the die for the uncurled shell of the easy open end of the present invention can form the seventh arc portion R7 (ferrule arc portion) with a smaller R angular radius, and the seventh arc portion R7 (ferrule arc portion) with a minimum R angular radius of 0.25 mm can be formed.

The smaller the R angular radius for forming of the seventh arc portion R7 (ferrule arc portion), the higher the pressure resistance of the uncurled shell. Therefore, the pressure resistance of the uncurled shell produce by the die for the uncurled shell of the easy open end of the present invention is higher.

Moreover, there is no thin-walled flange structure on the bottom end face of the upper die core 20 of the upper die core 13 of the present invention, so the service life of the upper die core body 20 of the present invention is higher.

3. Compared with Comparative Patent 1, the structure of the air chamber of the present invention is simpler.

In the FIG. 1 of Comparative Patent 1 (see the specification and figures of Comparative Patent), the air pressure of the annular external pressure sleeve 55 enters from the port 92, passes through the annular chamber 91 and the annular air pressure chamber 89, and finally acts on the annular external pressure sleeve 55.

The air pressure of the annular inner pressure sleeve 80 enters from the port 74, passes through the channel 76, reaches air storage chamber 70, and then passes through second air channel 88, reaches second air piston chamber 84, and finally acts on the annular inner pressure sleeve 80.

With this air chamber structure, the air channel of the annular inner pressure sleeve 80 is very complex, which increases the processing cost of the parts. At the same time, the air pressure inlet port 92 of the annular outer pressure sleeve 55 and the air pressure inlet port 74 of the annular inner pressure sleeve 80 are distributed at the left and right ends of the processing component 35.

When the multiple processing components 35 in two rows are produced with such a distributed inlet port, the operating space of the inlet port 92 and the inlet port 74 will be very small, and even unable to operate and install.

4. In the FIG. 2 of Comparative Patent 1 (see the specification and figures of Comparative Patent), the air pressure of the annular external pressure sleeve 55 enters from the port 92, passes through the annular chamber 91 and the annular air pressure chamber 89, and finally acts on the annular external pressure sleeve 55.

The air pressure of the annular inner pressure sleeve 80 enters from the port 92, passes through the annular chamber 91 and the third channel 135, reaches air storage chamber 70, and then passes through second air channel 88, reaches second air piston chamber 84, and finally acts on the annular inner pressure sleeve 80.

With this air chamber structure, the air channel of the annular inner pressure sleeve 80 is very complex, which increases the processing cost of the parts. The air pressure acting simultaneously on the annular outer pressure sleeve 55 and the annular inner pressure sleeve 80 is the same. When setting the air pressure on the annular outer pressure sleeve 55 and the annular inner pressure sleeve 80, it is necessary to take the larger value of the air pressure required for the annular outer pressure sleeve 55 and the annular inner pressure sleeve 80, which will result in a higher setting pressure for one of the pressure sleeves. The higher the air pressure, the more severe the surface wear of the part, the lower the service life of the part, and the more severe the thinning of the blank.

The air pressure of the upper inner forming ring 32 of the present invention (see the figures of the present invention) enters from the inlet port 40 of the upper forming ring, passes through the fourth air chamber 28, and finally acts on the upper inner forming ring 32.

The air pressure of the upper outer forming ring 14 enters from the inlet port 41 of the upper pressing ring, passes through the fifth air chamber 33, and finally acts on the upper outer forming ring 14.

Therefore, the structure of air chamber of the present invention is simple, and the air pressures of the upper inner forming ring 32 and the upper outer forming ring 14 can be set separately, which can make the air pressure settings of the upper inner forming ring 32 and the upper outer forming ring 14 more reasonable. Moreover, the inlet port of the upper forming ring 40 and the inlet port of the upper pressing ring 41 are distributed on the same side of the die for the uncurled shell of the easy open end, and when the multiple dies for the uncurled shells of the easy open ends in two rows are produced, the operation of the inlet port of the upper forming ring 40 and the inlet port of the upper pressing ring 41 is more convenient.

In the above figures: 1. Upper die; 2. Lower die; 3. Lower die base; 4. Lower die core ring; 5. Lower die core; 6. Lower pressing ring; 7. Lower blade; 8. First air chamber; 9. Second air chamber; 10. Lower cutting edge; 11. Annular recess for supporting and limiting of the ferrule forming; 12. Upper die base; 13. Upper die core; 14. Upper outer forming ring; 15. Upper blade; 16. R fillet of upper die core; 17. Third air chamber; 18. Upper cutting edge; 19. Upper die core base; 20. Upper die core body; 21. Lower die core base; 22. Lower die core body; 23. Vent hole; 24. Vent hole; 25. Vent hole; 26. Uncurled shell when forward forming is completed; 27. Uncurled shell after complete forming; 28. Fourth air chamber; 29. First blocking limit face; 30. Uncurled shell blank; 31. Annular depression; 32. Upper inner forming ring; 33. Fifth air chamber; 40. Inlet port of upper inner forming ring; 41. Inlet port of upper inner forming ring; R1. First arc portion; R2. Second arc portion; R3. Third arc portion; R4. Fourth arc portion; R5. Fifth arc portion; R6. Sixth arc portion; R7. Seventh arc portion; R8. Eighth arc portion; L1. First straight portion; L2. Second straight portion; L3. Third straight portion; L4. Fourth straight portion; L5. Fifth straight portion.

SPECIFIC EMBODIMENT

With reference to the accompanying drawings and embodiment, the present invention will be described in detail.

Figure 1:
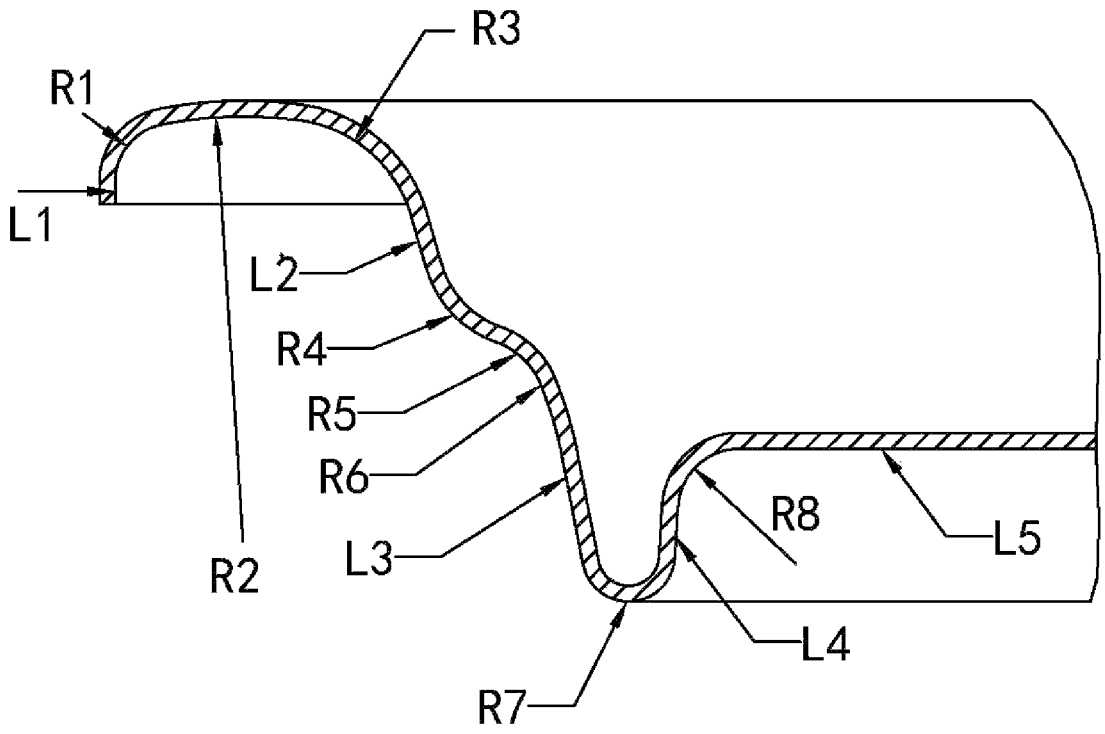
FIG. 1 is the partial sectional view of the uncurled shell of the easy open end (new end type) produced by the present invention.

The uncurled shell structure (new cover type) of a pressure-resistant easy open end in the embodiment of the present invention is shown in FIG. 1: On the cross section of the uncurled shell, it consists of a sealing portion, a countersink portion, a ferrule arc portion, an upward extension portion of ferrule and a center panel from periphery to center, and an annular recess is formed between the countersink portion, the ferrule arc portion and the upward extension portion of ferrule (shown in FIG. 1).

The sealing portion consists of a first straight portion L1, a first arc portion R1, a second arc portion R2 and a third arc portion R3, wherein:

One end of the first straight portion L1 is connected with the first end of the first arc portion R1, and the first straight portion L1 is tangent to the first arc portion R1; the second end of the first arc portion R1 is connected with the first end of the second arc portion R2, and the first arc portion R1 is tangent to the second arc portion R2; the second end of the second arc portion R2 is connected with the first end of the third arc portion R3, and the second arc portion R2 is tangent to the third arc portion R3.

The countersink portion consists of a second straight portion L2, a fourth arc portion R4, a fifth arc portion R5, a sixth arc portion R6, and a third straight portion L3, wherein:

The second end of the third arc portion R3 is connected with the first end of the second straight portion L2, and the third arc portion R3 is tangent to the second straight portion L2; the second end of the second straight portion L2 is connected with the first end of the fourth arc portion R4, and the second straight portion L2 is tangent to the fourth arc portion R4; the second end of the fourth arc portion R4 is connected with the first end of the fifth arc portion R5, and the fourth arc portion R4 is externally tangent to the fifth arc portion R5; the second end of the fifth arc portion R5 is connected with the first end of the sixth arc portion R6, and the fifth arc portion R5 is internally tangent to the sixth arc portion R6; the second end of the sixth arc portion R6 is connected with the first end of the third straight portion L3, and the sixth arc portion R6 is tangent to the third straight portion L3.

The ferrule arc portion consists of a seventh arc portion R7, wherein:

The second end of the third straight portion L3 is connected with the first end of the seventh arc section R7 and the second straight portion L2 is tangent to the seventh arc section R7.

The upward extension portion of ferrule consists of a fourth straight portion L4 and an eighth arc portion R8, wherein:

The second end of the seventh arc section R7 is connected with the first end of the fourth straight portion L4, and the fourth straight portion L4 is tangent to the seventh arc section R7; the second end of the fourth straight portion L4 is connected with the first end of the eighth arc portion R8, and the fourth straight portion L4 is tangent to the eighth arc portion R8.

The center panel consists of a fifth straight portion L5, wherein:

The second end of the eighth arc portion R8 is connected with the first end of the fifth straight portion L5, and the eighth arc portion R8 is tangent to the fifth straight portion L5.

Embodiment 1: A Pressing Die for an Uncurled Shell of a Pressure-Resistant Easy Open End (without Pre-Formed Pressing Die)

Figure 2:
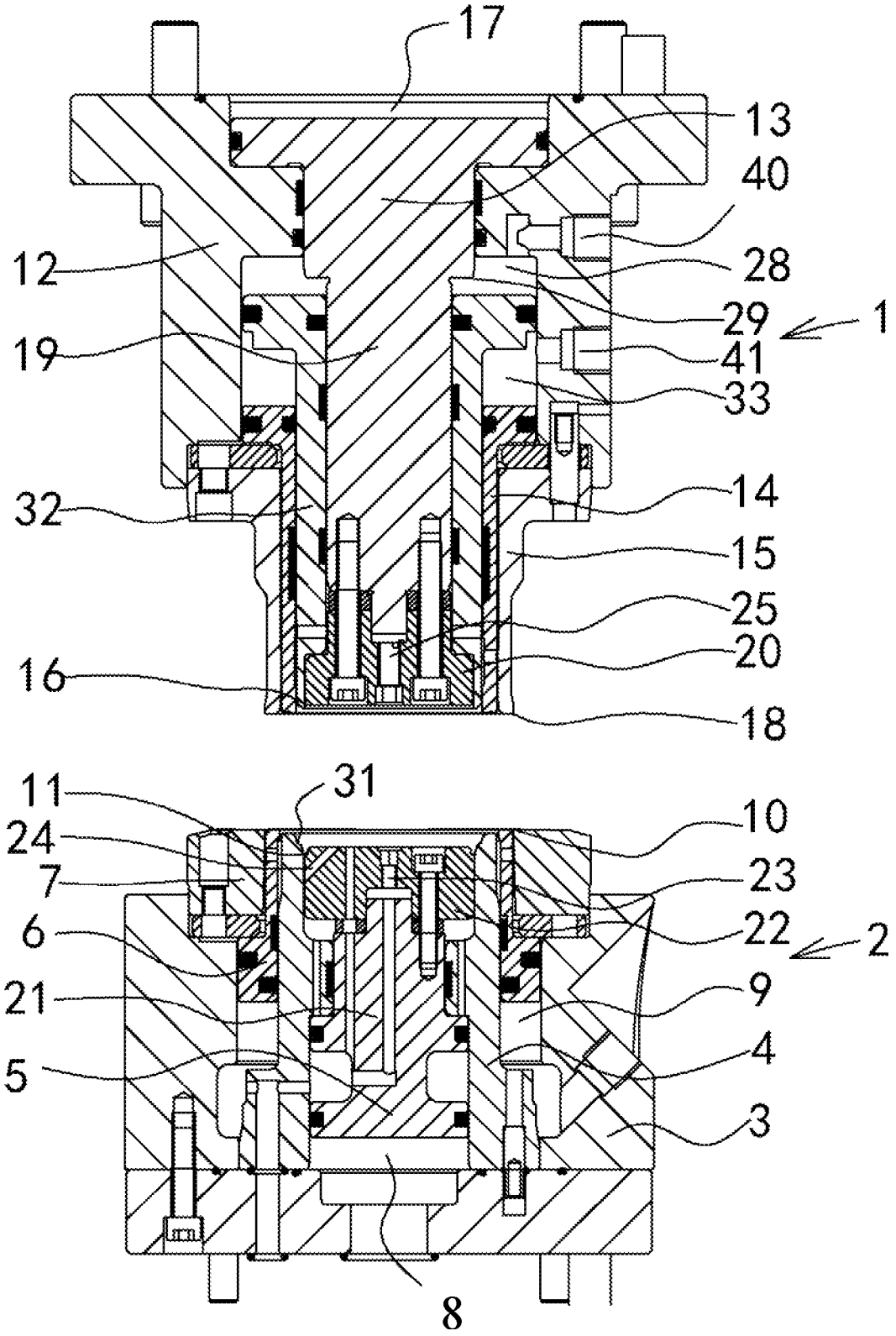
FIG. 2 is the sectional view of a non-preformed pressing die in the embodiment 1 of the present invention, showing the separated state of the upper die and the lower die.
Figure 3:
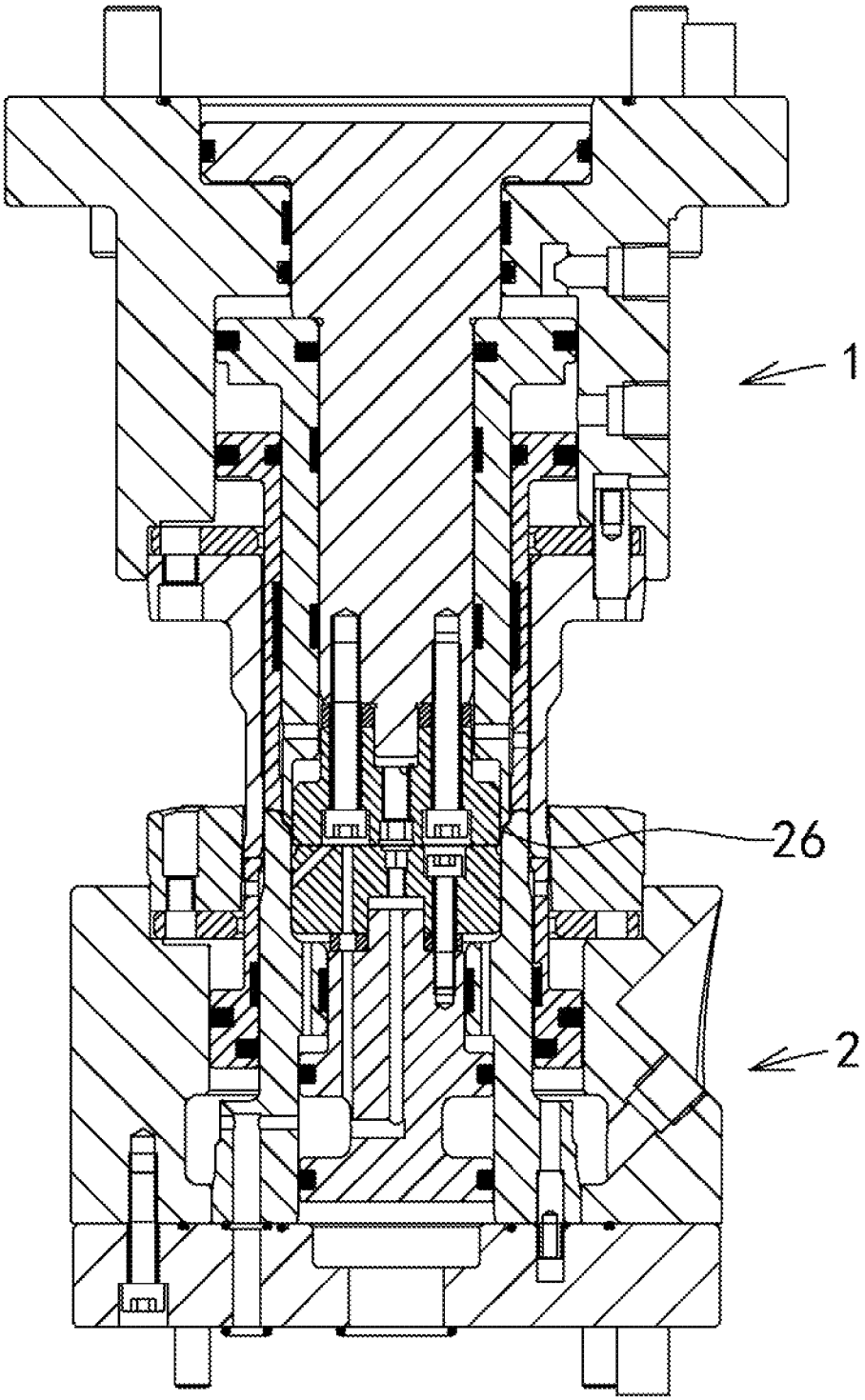
FIG. 3 is the sectional view of a non-preformed pressing die in the embodiment 1 of the present invention, showing the state of the upper and lower dies at the lower dead center position under the press, that is, the state when the forward forming of the uncurled shell of the easy open end is completed.
Figure 4:
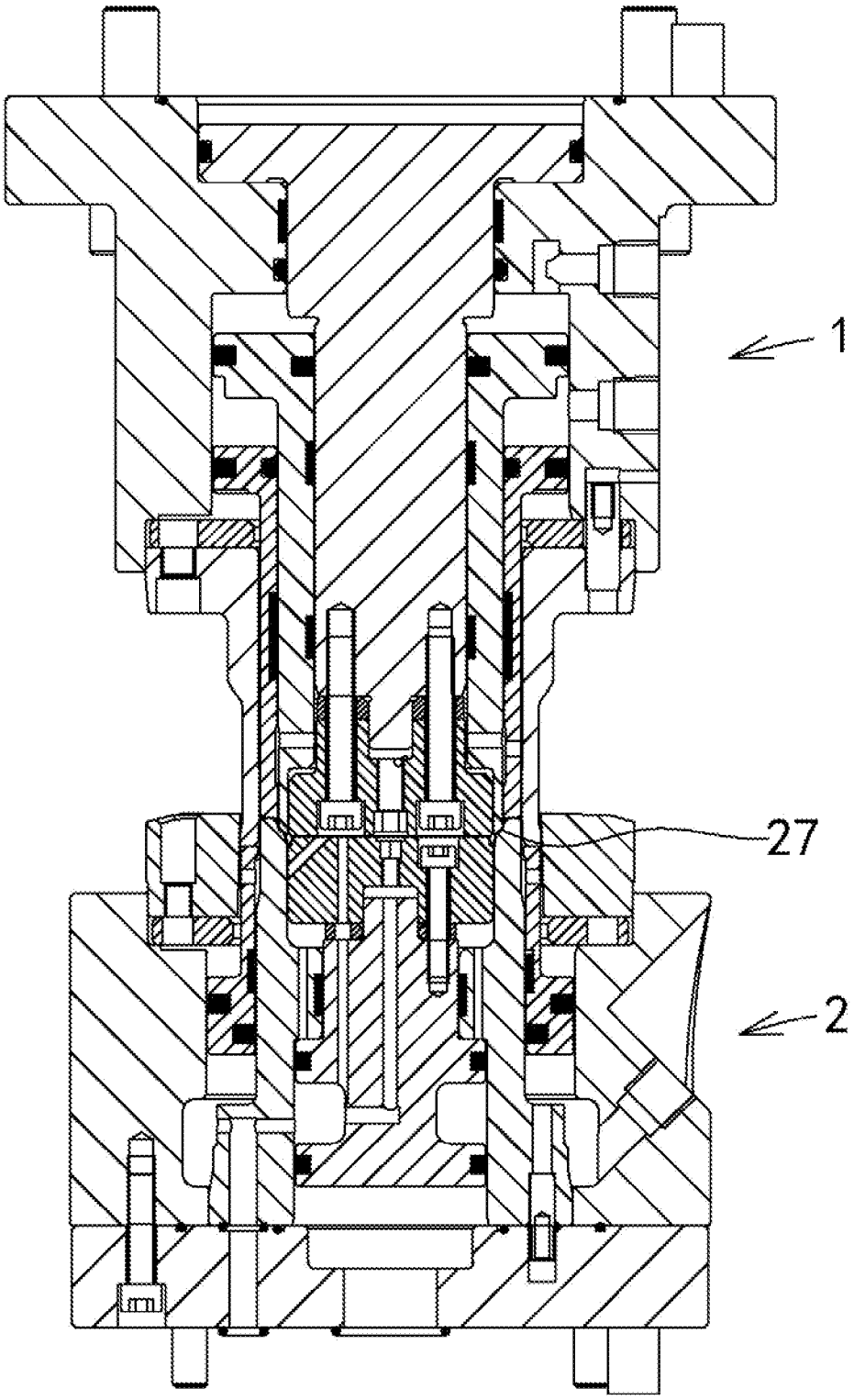
FIG. 4 is the sectional view of a non-preformed pressing die in the embodiment 1 of the present invention, showing the state of the upper and lower dies when the full forming of the uncurled shell of the easy open end is completed.

As shown in FIGS. 1-3, the pressing die consists of two parts of a lower die 2 and an upper die 1 (see FIG. 2).

The lower die 2 mainly consists of a lower die base 3, a lower die core ring 4, a lower die core 5, a lower pressing ring 6, and a lower blade 7 (see FIG. 2), wherein the lower die base 3 is a cylinder with an upper opening (see FIG. 2).

The lower die core ring 4 is an annular body, which is fixed in the opening of the lower die base 3 through the locating pin and the bolt and concentric with the lower die base 3 (see FIG. 2).

The lower die core 5 consists of a lower die core base 21 and a lower die core body 22 (see FIG. 2). The lower die core base 21 is fixedly connected with the lower die core body 22, and the action part of the lower die core 5 is the lower die core body 22. The lower die core body 22 is a cylindrical body, which is embedded in the lower die core ring 4 and works with the lower die core ring 4 in the up and down directions in a slidable way (see FIG. 2).

A first air chamber 8 is sealed and formed under the lower die core 5 in the lower die core ring 4 (see FIG. 2) and the air pressure of the first air chamber 8 is used to support the lower die core 5.

The lower die core body 22 is equipped with a vent hole 23 and a vent hole 24 (see FIG. 2), which are used for venting when pressing the uncurled shell.

The lower pressing ring 6 is an annular body, which is embedded between the lower die base 3 and the lower die core ring 4 (see FIG. 2), and a second air chamber 9 is sealed and formed between the lower die base 3 and the lower die core ring 4 under the lower pressing ring 6, and the air pressure of the second air chamber 9 is used to support the lower pressing ring 6 (see FIG. 2).

The lower blade 7 is an annular body, which is fixed on the edge of the upper opening of the lower die base 3, and a lower cutting edge 10 is provided on the inner edge of the top of the annular body.

The upper die 1 mainly consists of an upper die base 12, an upper die core 13, an upper inner forming ring 32, an upper outer forming ring 14, and an upper blade 15 (see FIG. 2), wherein the upper die base 12 is a cylinder with a lower opening.

The upper die core 13 consists of an upper die core base 19 and an upper die core body 20 (see FIG. 2). The upper die core base 19 is fixedly connected with the upper die core body 20 through a bolt and a spacer (see FIG. 2). The action part of the upper die core 13 is the upper die core body 20. The upper die core body is a cylindrical body, which is arranged in the upper die base 12 and concentric with the upper die base 12 (see FIG. 2).

The upper die core 13 is slidably matched with the upper die base 12 in the upward and downward directions, and the lower die core body 12 is equipped with a vent hole 25 (see FIG. 2), which is used for venting when pressing the uncurled shell.

The upper die core body 20 is equipped with a R fillet of the upper die core body at the bottom corner (see FIG. 2).

A third air chamber 17 is sealed and formed above the upper die core 13 in the upper die base 12, and the air pressure of the third air chamber 17 is used to press against the upper die core 13.

The upper inner forming ring 32 is an annular body, which is embedded between the upper die core 13 and the upper die base 12 (see FIG. 2), and a fourth air chamber 28 is sealed and formed between the upper die core 13 and the upper die base 12 above the upper inner forming ring 32 (see FIG. 2), and the air pressure of the fourth air chamber 28 is used to press against the upper inner forming ring 32, and the fourth chamber 28 is equipped with an inlet port of the upper inner forming ring 40 on the upper die base 12 (see FIG. 2).

The upper outer forming ring 14 is an annular body, which is embedded between the upper die base 12 and the upper inner forming ring 32 (see FIG. 2), and a fifth air chamber 33 is sealed and formed between the upper die base 12 and the upper inner forming ring 32 above the upper outer forming ring 14 (see FIG. 2), and the air pressure of the fifth air chamber 33 is used to press against the upper outer forming ring 14, and the fifth chamber 33 is equipped with an inlet port of the upper inner forming ring 41 on the upper die base 12.

The upper blade 15 is an annular body, which is fixed on the edge of the lower opening of the upper die base 12, and a upper cutting edge 18 matched with the lower cutting edge 10 is provided on the outer edge of the bottom of the upper blade 15.

In order to solve the reliability and service life problems of the original pressing die for the uncurled shell of the easy open end on the basis of adapting to the easy open end type, the following parts have been improved in this embodiment:

For the uncurled shell (shown in FIG. 1), the uncurled shell consists of a sealing portion, a countersink portion, a ferrule arc portion, an upward extension portion of ferrule and a center panel on the cross section from periphery to center, and an annular recess is formed between the countersink portion, the ferrule arc portion and the upward extension portion of ferrule; the sealing portion is formed by a tangent connection of a first straight portion L1, a first arc portion R1, a second arc portion R2, and a third arc portion R3; the countersink portion is formed by a tangent connection of a second straight portion L2, a fourth arc portion R4, a fifth arc portion R5, a sixth arc portion R6 and a third straight portion L3; the ferrule arc section is formed of a seventh arc portion R7; the upward extension portion of ferrule is formed by a tangent connection of a fourth straight line L4 and an eighth arc portion R8; the center panel is formed by a fifth straight line L5.

The upper outer forming ring 14 and the upper inner forming ring 32 of the upper die 1 match with the lower die core ring of the lower die up and down, wherein the lower die core ring 4 is provided with a contour on its top corresponding to the first straight portion L1, the first arc portion R1, the second arc portion R2, the third arc portion R3, the second straight portion L2, the fourth arc portion R4, the fifth arc portion R5, the sixth arc portion R6 and the third straight portion L3 of the uncurled shell, wherein an annular depression 31 is formed at the top of the lower die core ring 4 corresponding to the position of the second straight portion L2, the fourth arc portion R4, the fifth arc portion R5 and sixth arc portion R6 of the uncurled shell (see FIG. 2).

The upper outer forming ring 14 is provided with a contour on the bottom corresponding to the second arc portion R2 of the uncurled shell, while the parts at the bottom of the upper outer forming ring 14 corresponding to the first arc portion R1 and third arc portion R3 of the uncurled shell are suspended relative to the top of the lower die core ring 4 in a closed state.

The upper inner forming ring 32 is provided with a contour on the bottom corresponding to the fourth arc portion R4 and the fifth arc portion R5 of the uncurled shell, while the parts at the bottom of the upper inner forming ring 32 corresponding to the second straight portion L2, the sixth arc portion R6 and third straight portion L3 of the uncurled shell are suspended relative to the top of the lower die core ring 4 in a closed state.

The upper die core 13 of the upper die 1 matches with the lower die core 5 of the lower die 2 up and down, wherein the lower die core 5 is provided with a contour on its top corresponding to the seventh arc portion R7, the fourth straight portion L4, the eighth arc portion R8 and the fifth straight portion L5 of the uncurled shell, wherein an annular recess for supporting and limiting of the ferrule forming is formed on the top of the lower die core 5 corresponding to the seventh arc portion R7, the fourth straight portion L4 and the eighth arc portion R8 of the uncurled shell (see FIG. 2).

The upper die core 13 is provided with a contour on its bottom corresponding to the fifth straight portion L5 of the uncurled shell.

The parts at the bottom of the upper die core 13 corresponding to the seventh arc portion R7, the fourth straight portion L4 and the eighth arc portion R8 of the uncurled shell are suspended relative to the top of the lower die core 5 in a closed state.

Figure 5:
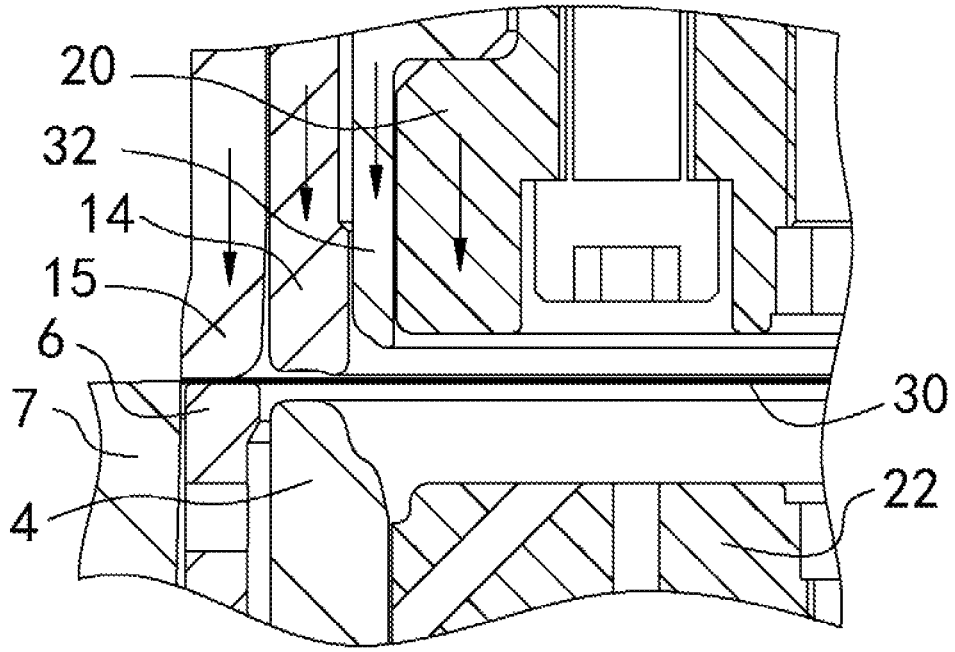
FIG. 5 is the local enlarged view of pressing process 1 in the embodiment 1 of present invention.

The uncurled shell pressing forming process of the embodiment 1 is shown in FIGS. 5 to 15, where FIG. 5 shows the pressing forming process 1. From FIG. 5, it can be seen that the upper die 1 moves downwards as a whole, and FIG. 30 shows the uncurled shell blank.

Figure 6:
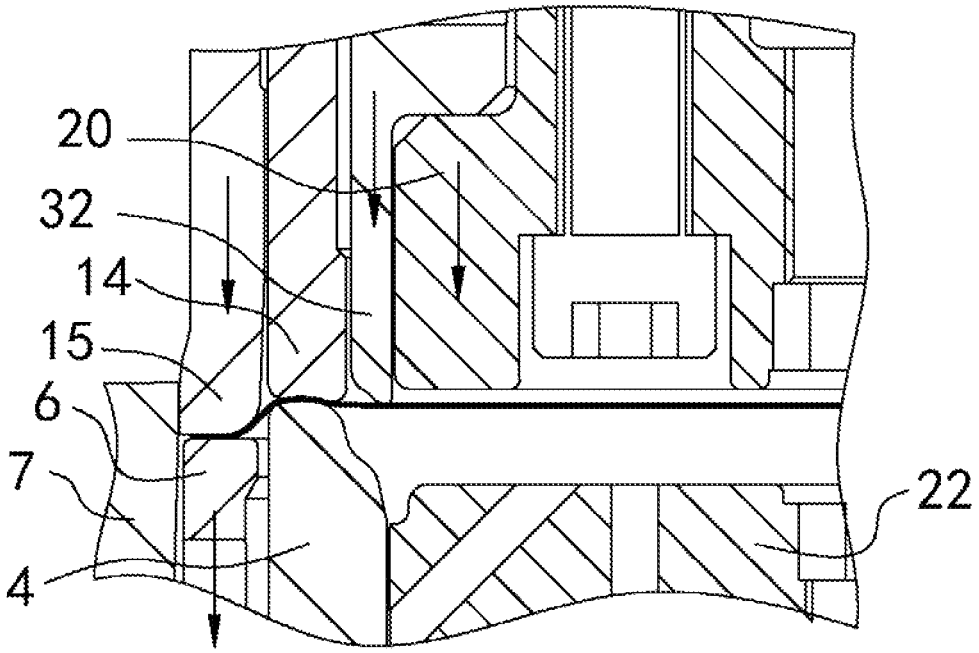
FIG. 6 is the local enlarged view of pressing process 2 in the embodiment 1 of present invention.

FIG. 6 shows the pressing forming process 2. From FIG. 6, it can be seen that the upper blade 5 of the upper die and the lower blade 7 of the lower die 2 first cut to get the uncurled shell blanket 30, and then the upper blade 15 pushes the lower pressing ring 6 to move downward by the uncurled shell blanket 30.

As the lower die core ring 4 is fixed on the lower die base 3, the upper outer forming ring 14 presses against the lower die core ring 4 to keep stationary by the uncurled shell blanket 30.

Figure 7:
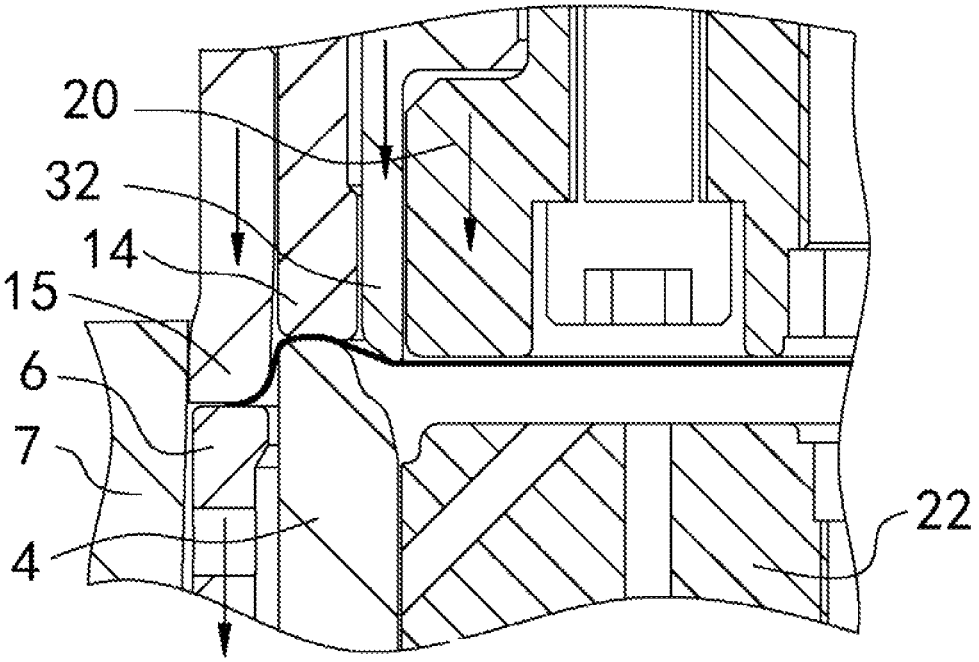
FIG. 7 is the local enlarged view of pressing process 3 in the embodiment 1 of present invention.

FIG. 7 shows the pressing forming process 3. From FIG. 7, it can be seen that the uncurled shell blank 30 has deformation relative to FIG. 6.

Figure 8:
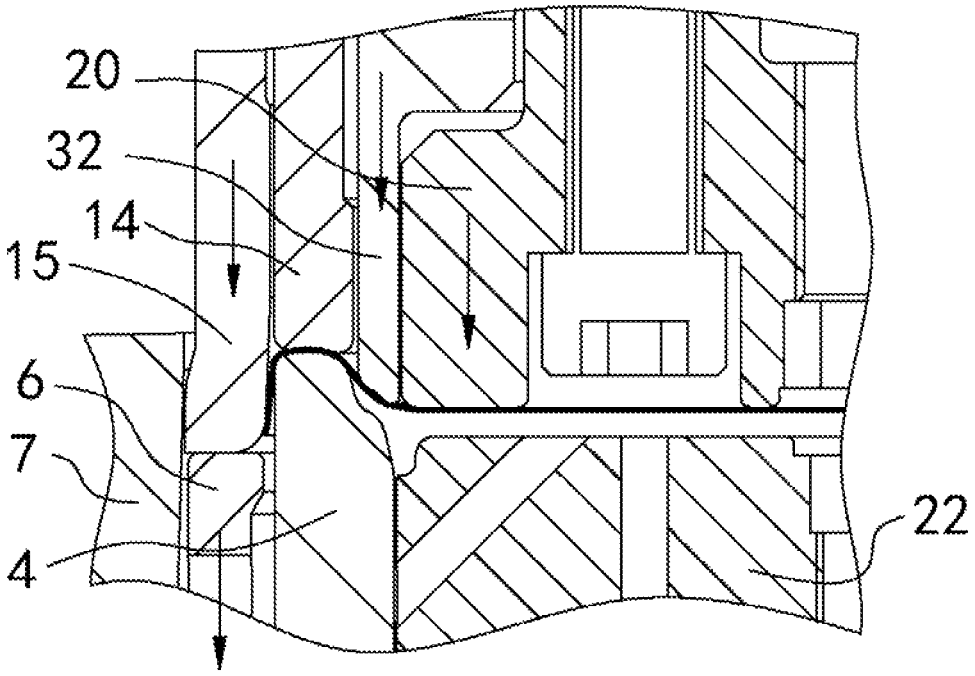
FIG. 8 is the local enlarged view of pressing process 4 in the embodiment 1 of present invention.

FIG. 8 shows the pressing forming process 4. From FIG. 8, it can be seen that the uncurled shell blank 30 between the upper blade 15 and the lower pressing ring 6 has slipped, the upper blade 15 directly contacts the lower pressing ring 6, and the upper inner forming ring 32 and the upper die core body 20 have started to contact the uncurled shell blank 30.

Figure 9:
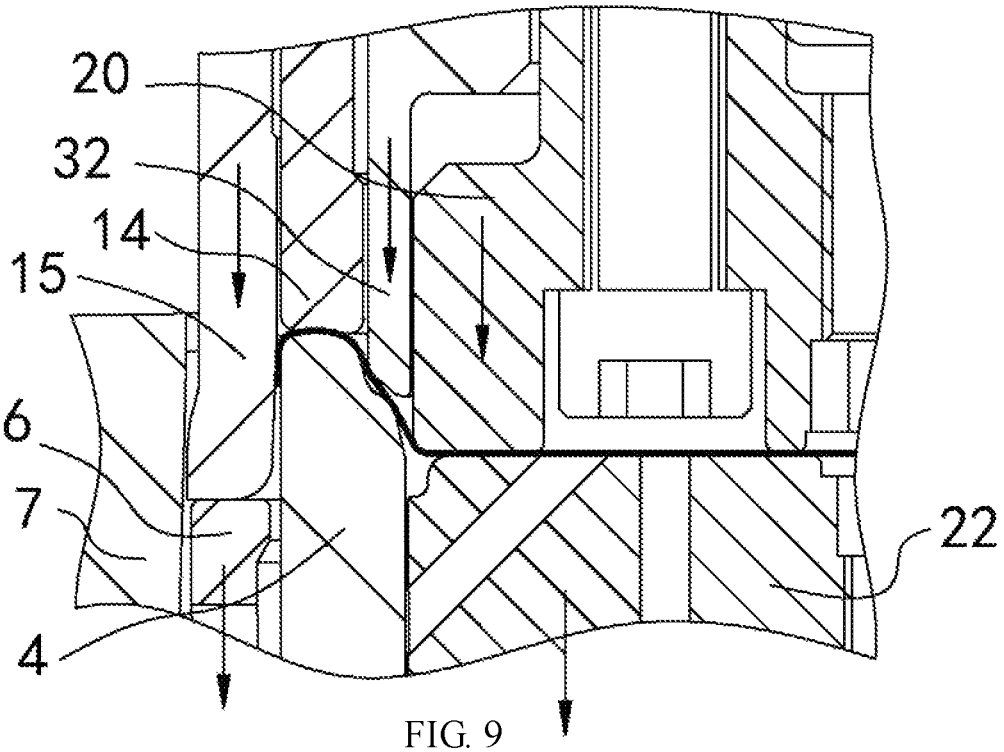
FIG. 9 is the local enlarged view of pressing process 5 in the embodiment 1 of present invention.

FIG. 9 shows the pressing forming process 5. From FIG. 9, it can be seen that the upper die core body 20 pushes the lower die core body 22 to move downward by the uncurled shell blanket 30.

Figure 10:
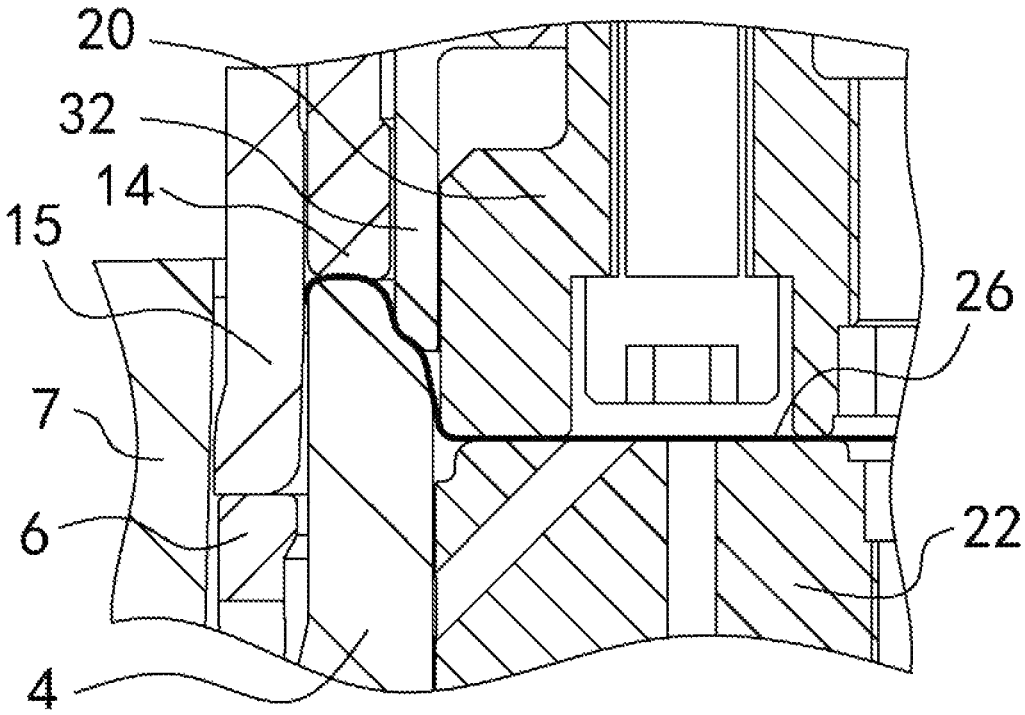
FIG. 10 is the local enlarged view of pressing process 6 in the embodiment 1 of present invention.

FIG. 10 shows the pressing forming process 6. From FIG. 10, it can be seen that the upper die 1 and lower die 2 are in the state of the dead center position under the press, which is the state when the forward forming of the uncurled shell of the easy open end is completed. Refer to the uncurled shell 26 when the forward forming is completed in FIG. 10.

Figure 11:
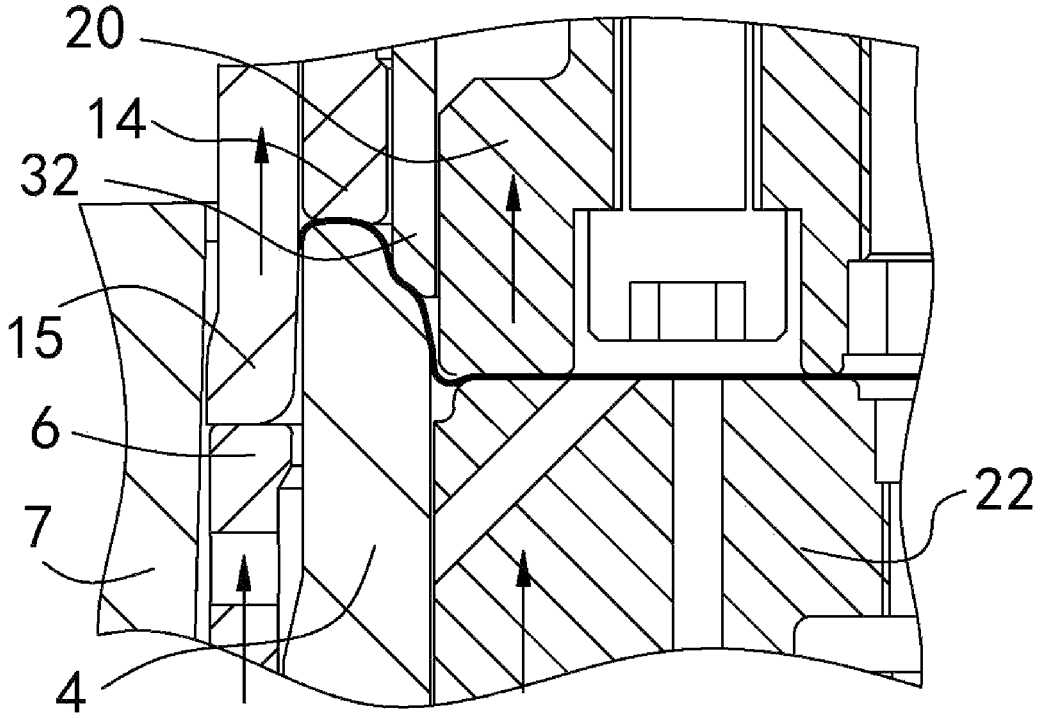
FIG. 11 is the local enlarged view of pressing process 7 in the embodiment 1 of present invention.

FIG. 11 shows the pressing forming process 7. From FIG. 11, it can be seen that the upper die 1 moves upwards, while the lower pressing ring 6 and the lower die core body 22 also move upwards under the action of the corresponding first air chamber 8 and second air chamber 9.

Figure 12:
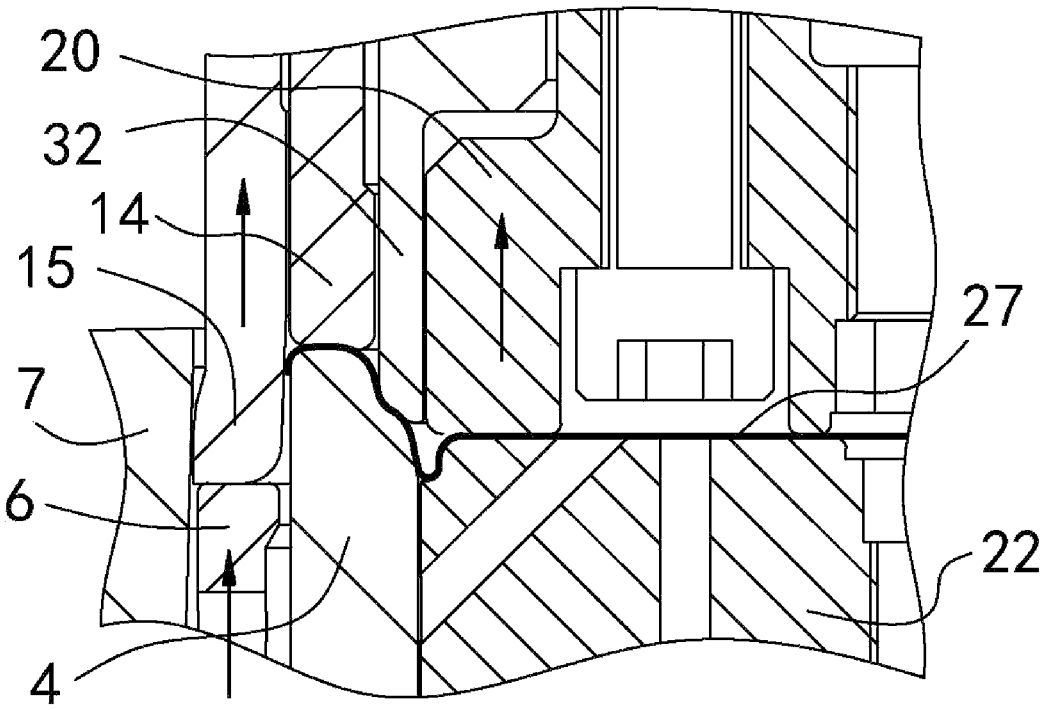
FIG. 12 is the local enlarged view of pressing process 8 in the embodiment 1 of present invention.

FIG. 12 shows the pressing forming process 8. From FIG. 12, it can be seen that the lower die core body 22 has moved to the upper dead center position and is not moving upwards. At this time, the upper and lower molds are in the state when the uncurled shell of the easy open end is fully formed, as shown in FIG. 12 when the uncurled shell 27 is fully formed.

Figure 13:
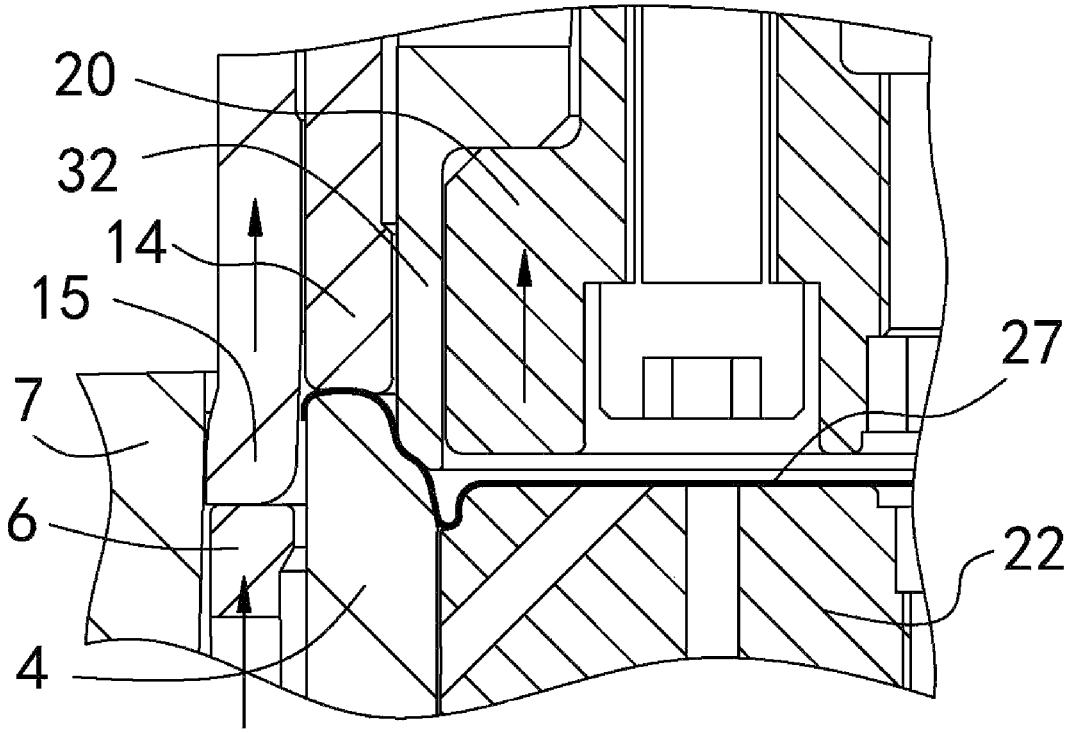
FIG. 13 is the local enlarged view of pressing process 9 in the embodiment 1 of present invention.

FIG. 13 shows the pressing forming process 9. From FIG. 13, it can be seen that the upper die core body 20 has left the fully formed uncurled shell 27.

Figure 14:
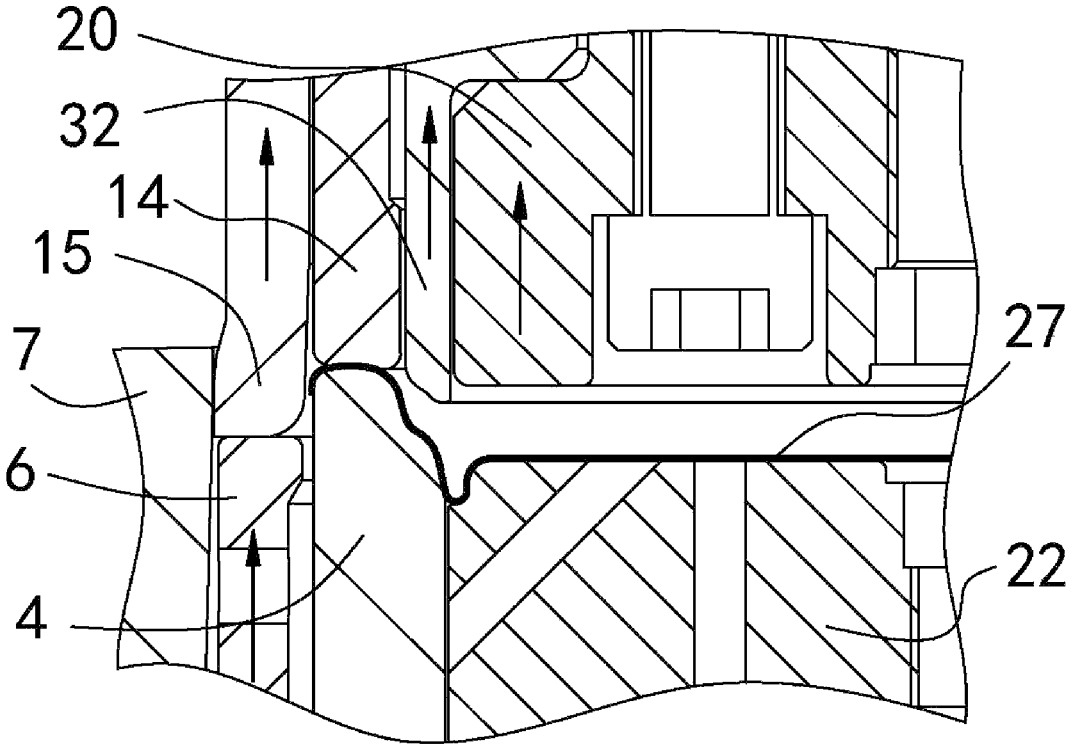
FIG. 14 is the local enlarged view of pressing process 10 in the embodiment 1 of present invention.

FIG. 14 shows the pressing forming process 10. From FIG. 14, it can be seen that the upper inner forming ring 32 has left the fully formed uncurled shell 27.

Figure 15:
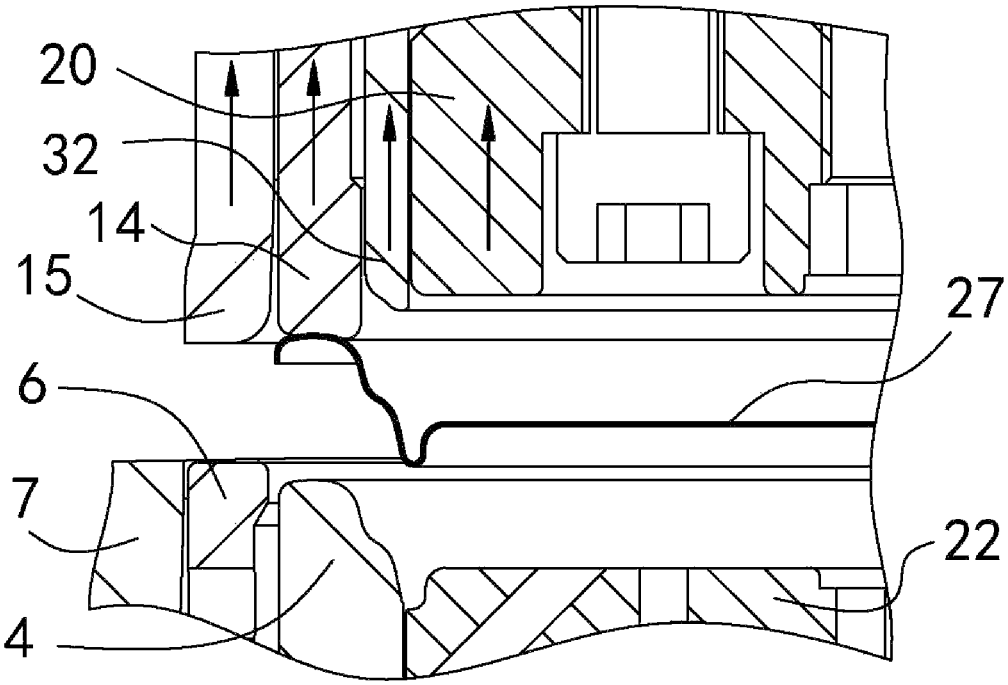
FIG. 15 is the local enlarged view of pressing process 11 in the embodiment 1 of present invention.

FIG. 15 shows the pressing forming process 11. From FIG. 15, it can be seen that the fully formed uncurled shell 27 ejects out of the die.

Embodiment 2: A Pressing Die for an Uncurled Shell of a Pressure-Resistant Easy Open End (with Pre-Formed Pressing Die)

Figure 16:
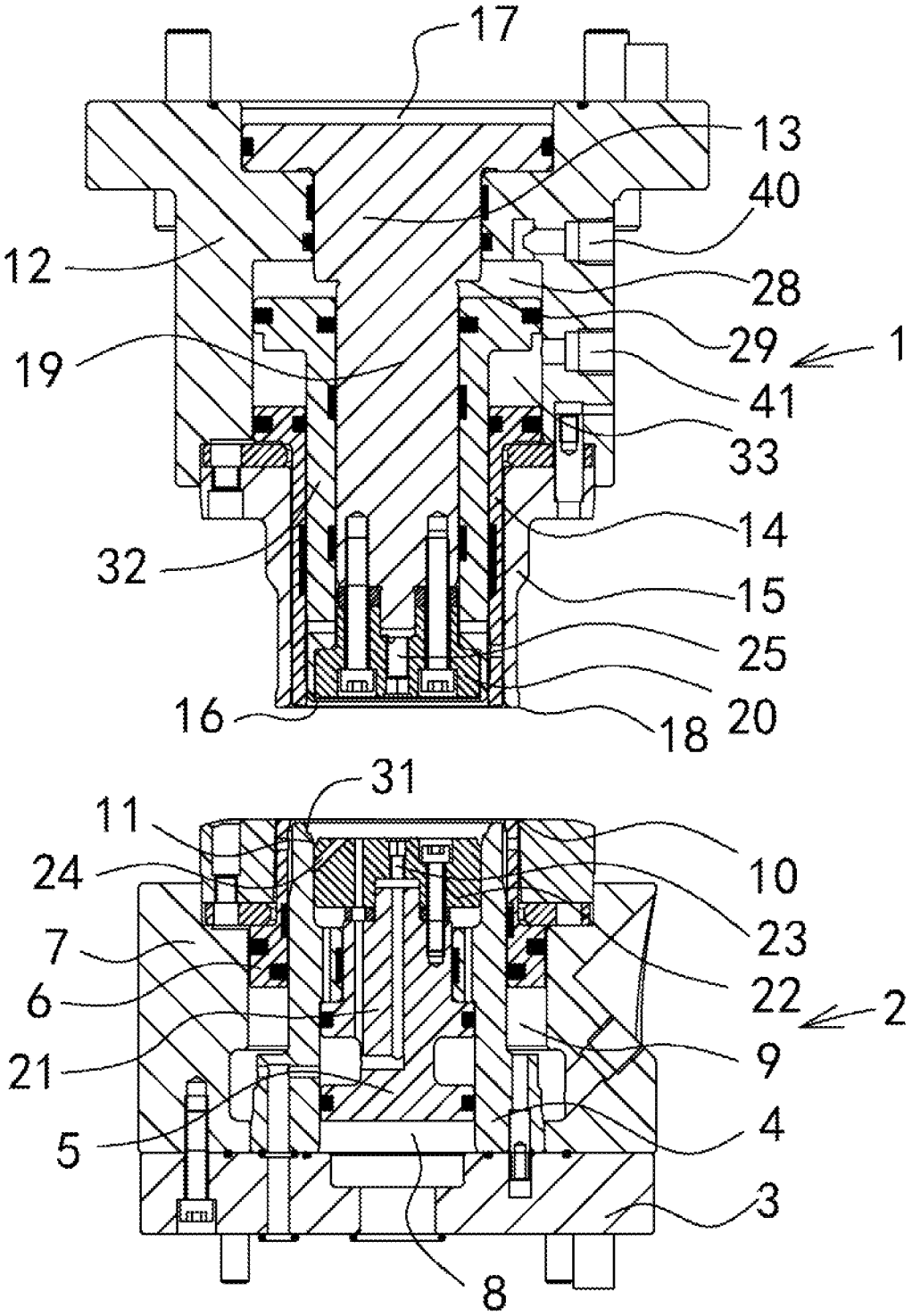
FIG. 16 is the sectional view of a preformed pressing die in the embodiment 2 of the present invention, showing the separated state of the upper die and the lower die.

As shown in FIG. 16, the pressing die consists of two parts of a lower die 2 and an upper die 1 (see FIG. 16).

The difference between the embodiment 2 and the embodiment 1 is that: the bottom of the upper die core body 20 is different, and the bottom of the upper die core body 20 in the embodiment 1 is flat, and the parts at the bottom of the upper die core body 20 corresponding to the seventh arc portion R7, the fourth straight portion L4 and the eighth arc portion R8 of the uncurled shell are suspended relative to the top of the lower die core body 22 in a closed state.

Figure 17:
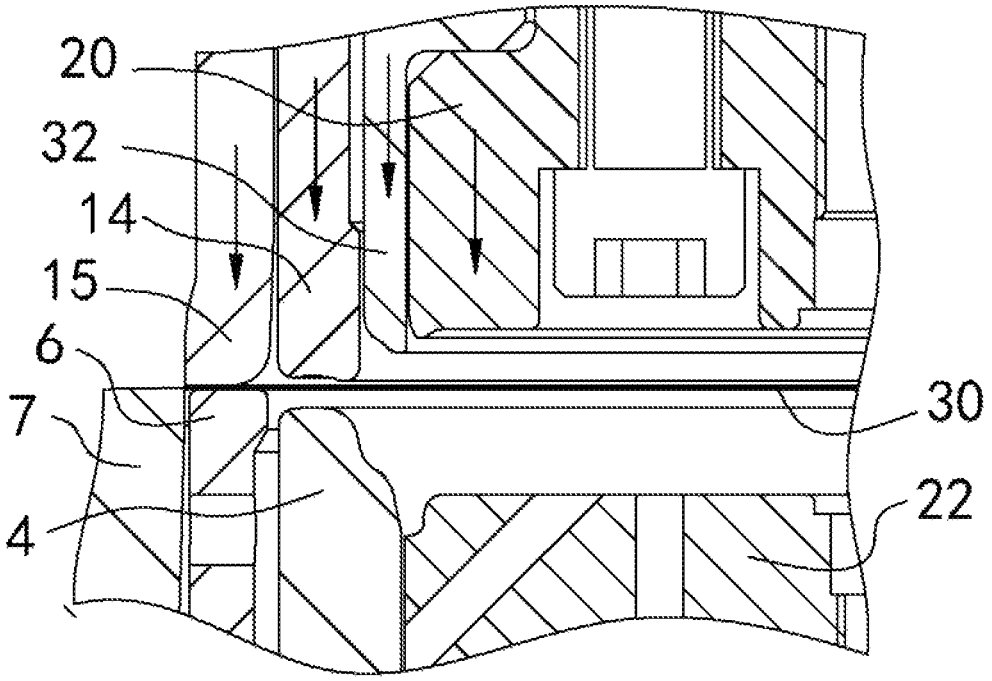
FIG. 17 is the local enlarged view of pressing process 2 in the embodiment 2 of present invention.
Figure 18:
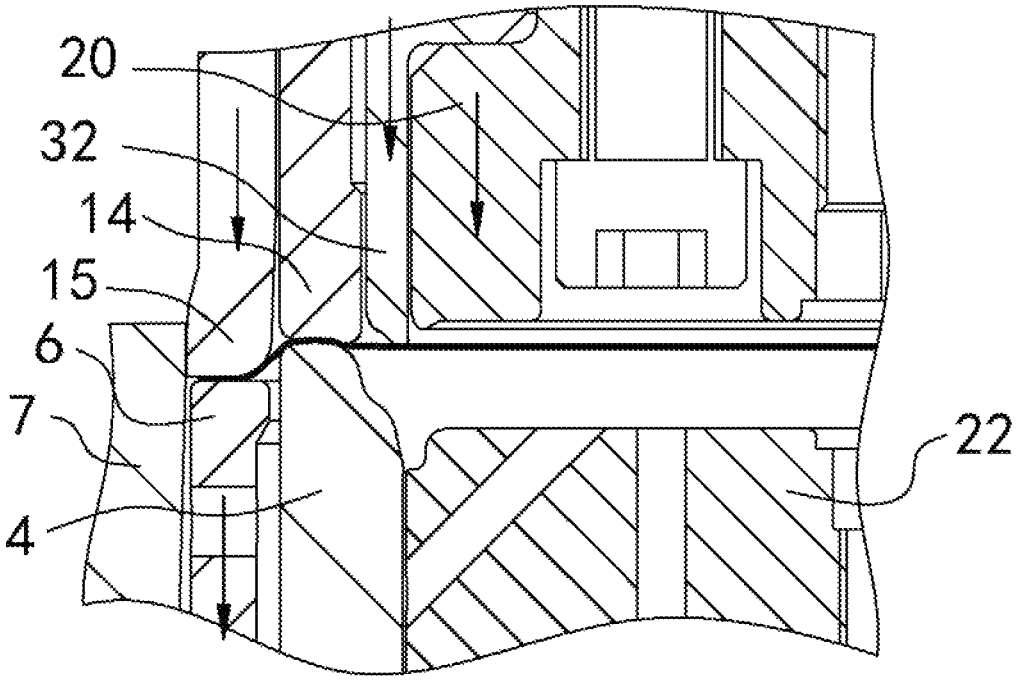
FIG. 18 is the local enlarged view of pressing process 2 in the embodiment 2 of present invention.
Figure 19:
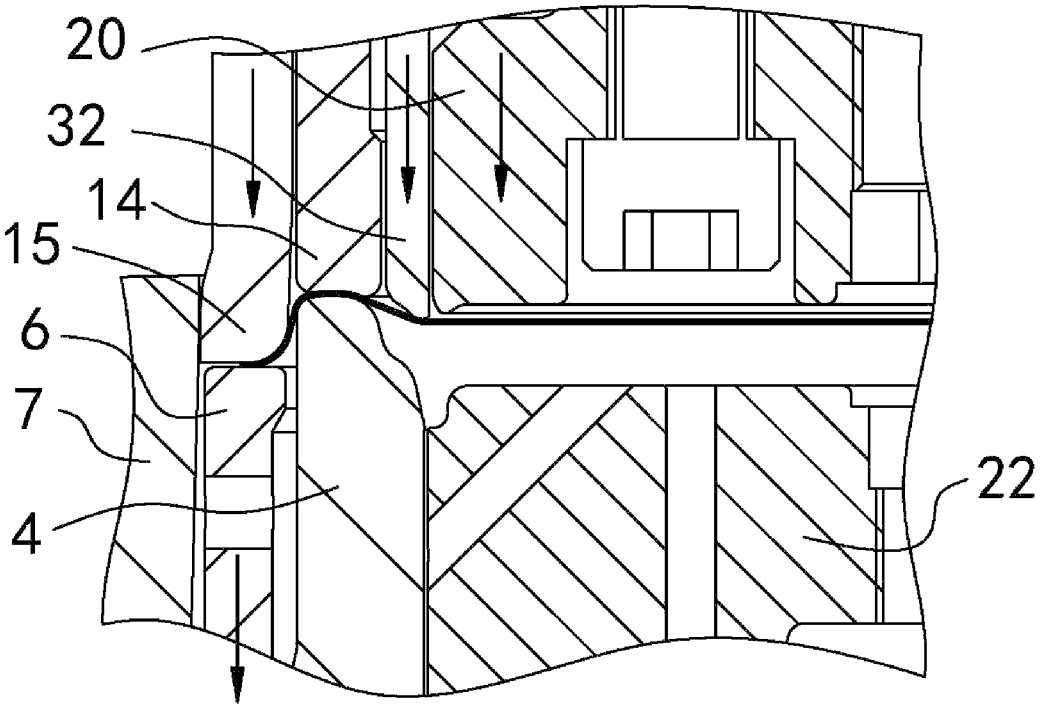
FIG. 19 is the local enlarged view of pressing process 3 in the embodiment 2 of present invention.
Figure 20:
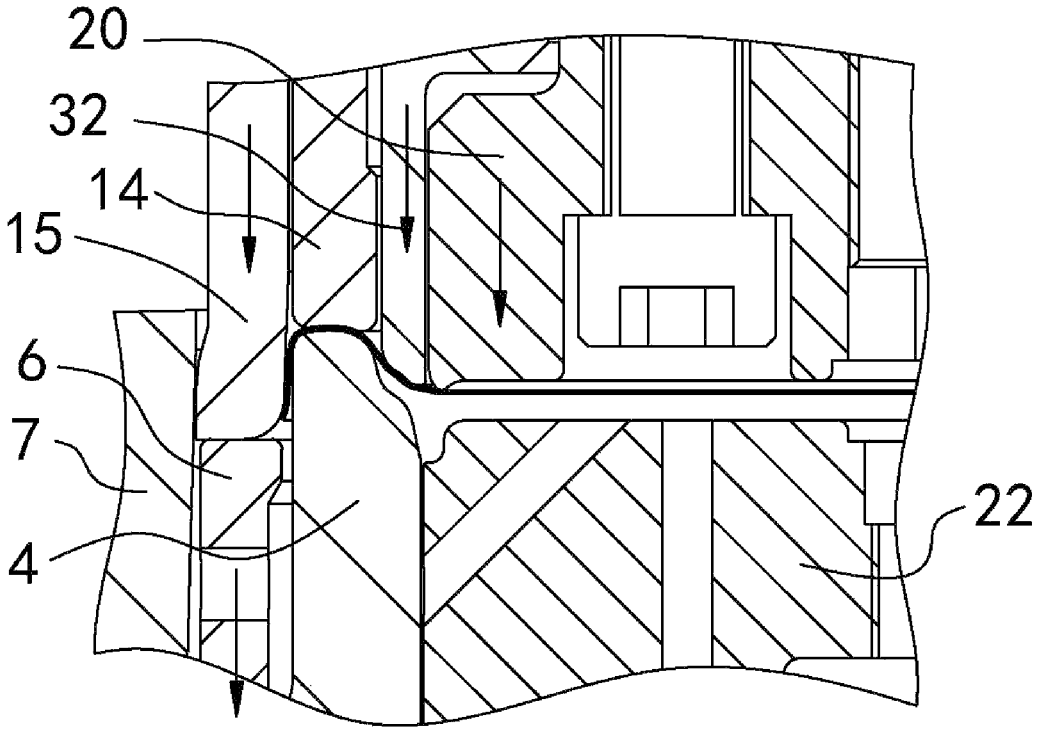
FIG. 20 is the local enlarged view of pressing process 4 in the embodiment 2 of present invention.
Figure 21:
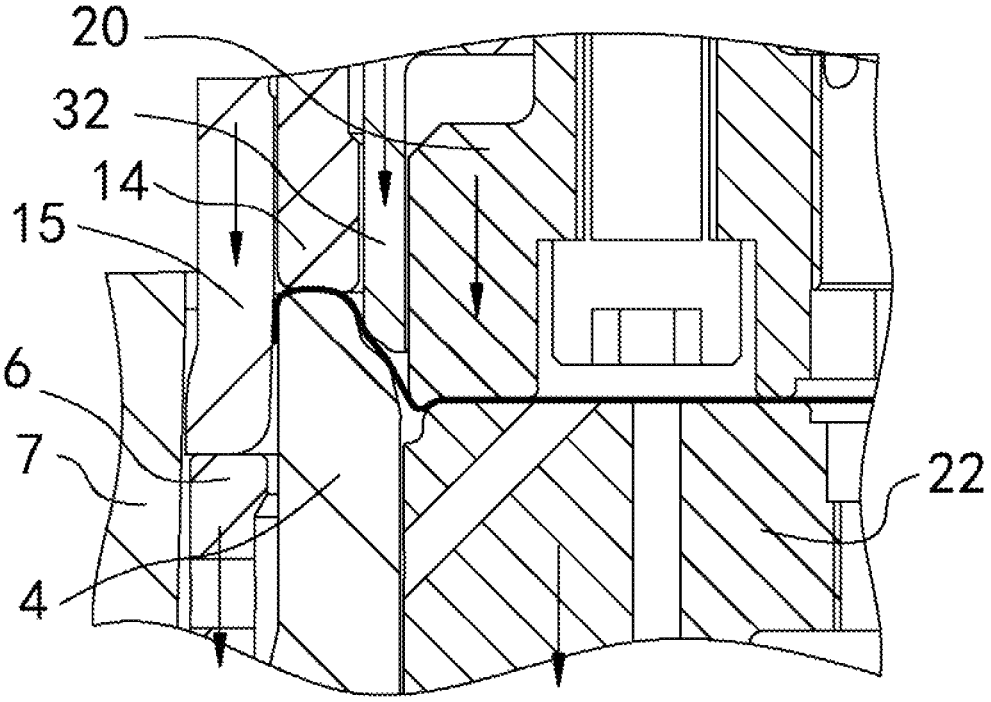
FIG. 21 is the local enlarged view of pressing process 5 in the embodiment 2 of present invention.
Figure 22:
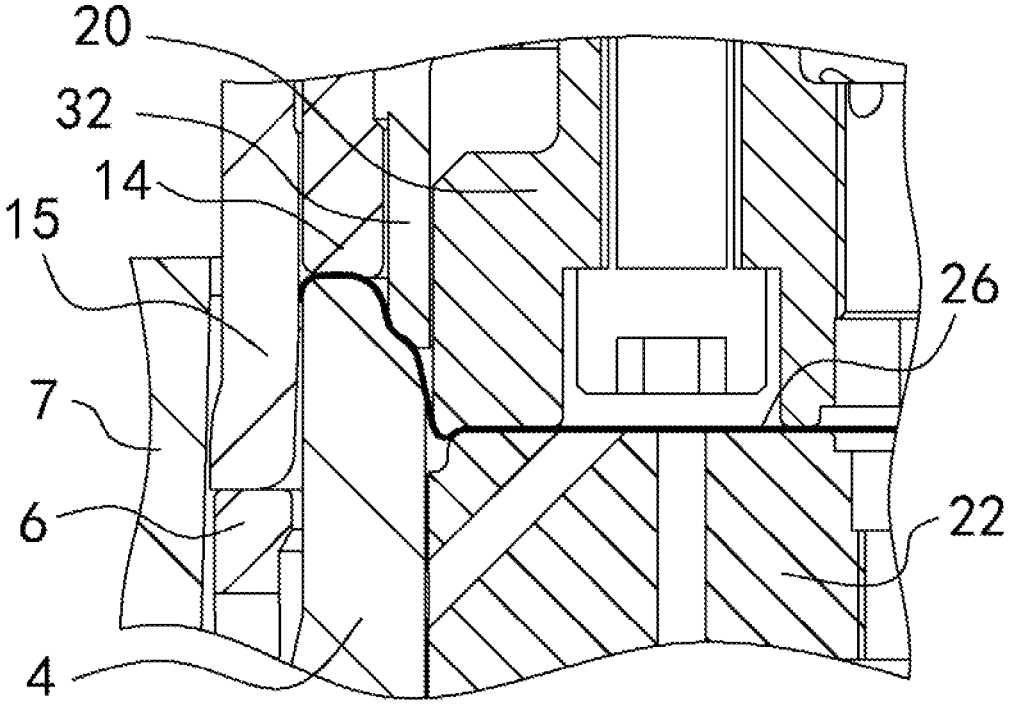
FIG. 22 is the local enlarged view of pressing process 6 in the embodiment 2 of present invention.
Figure 23:
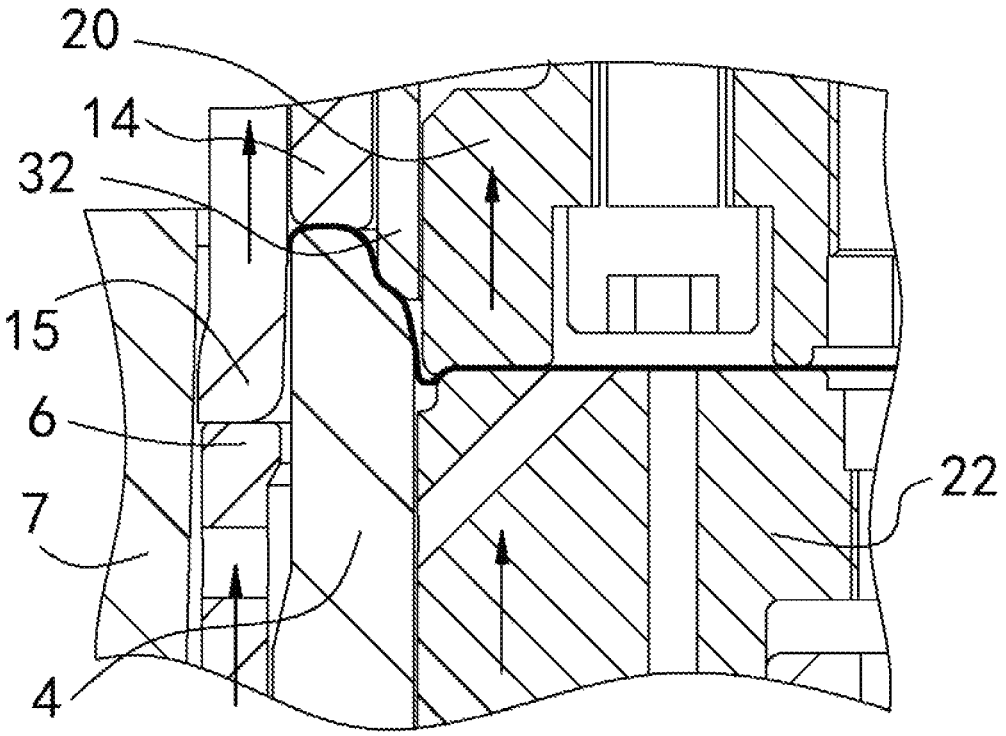
FIG. 23 is the local enlarged view of pressing process 7 in the embodiment 2 of present invention.
Figure 24:
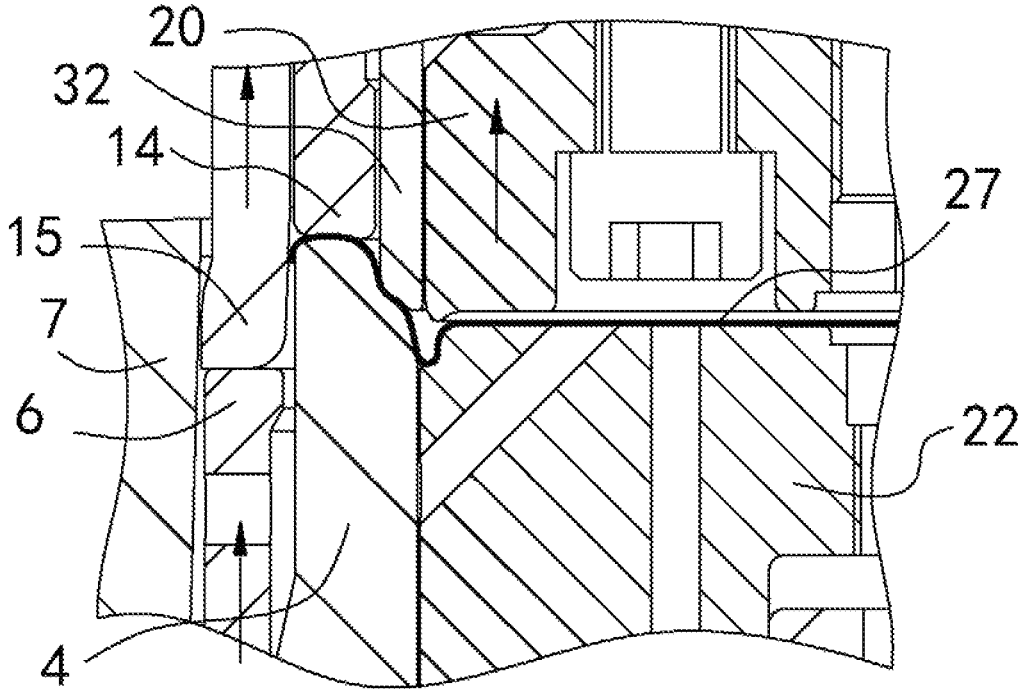
FIG. 24 is the local enlarged view of pressing process 8 in the embodiment 2 of present invention.
Figure 25:
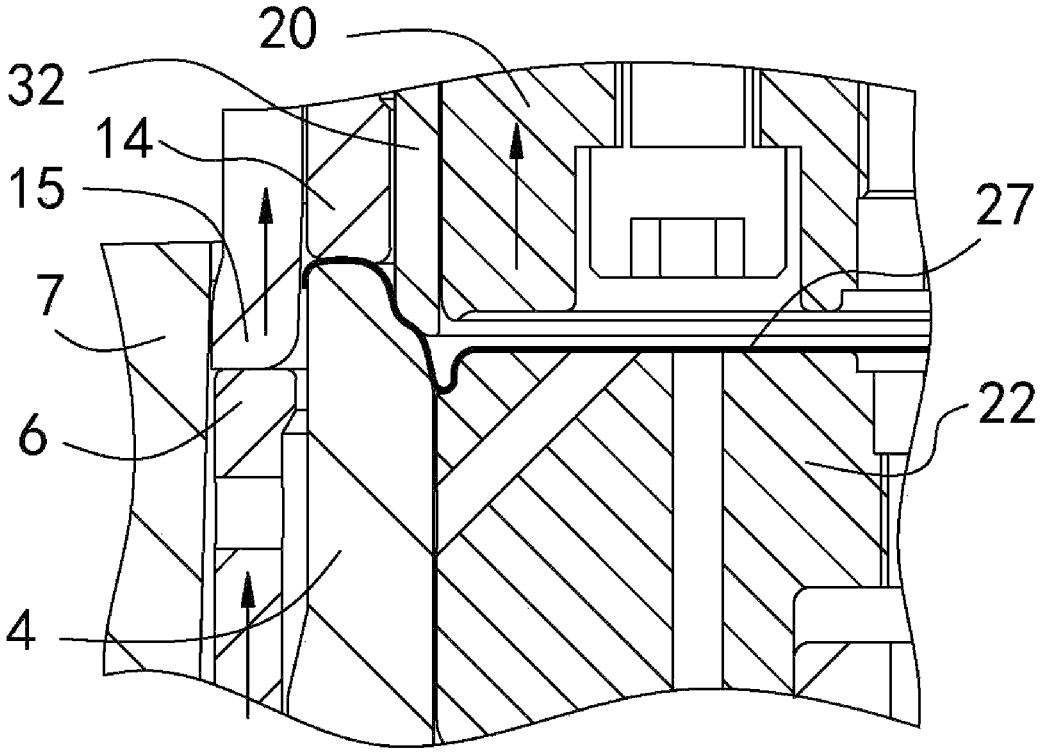
FIG. 25 is the local enlarged view of pressing process 9 in the embodiment 2 of present invention.
Figure 26:
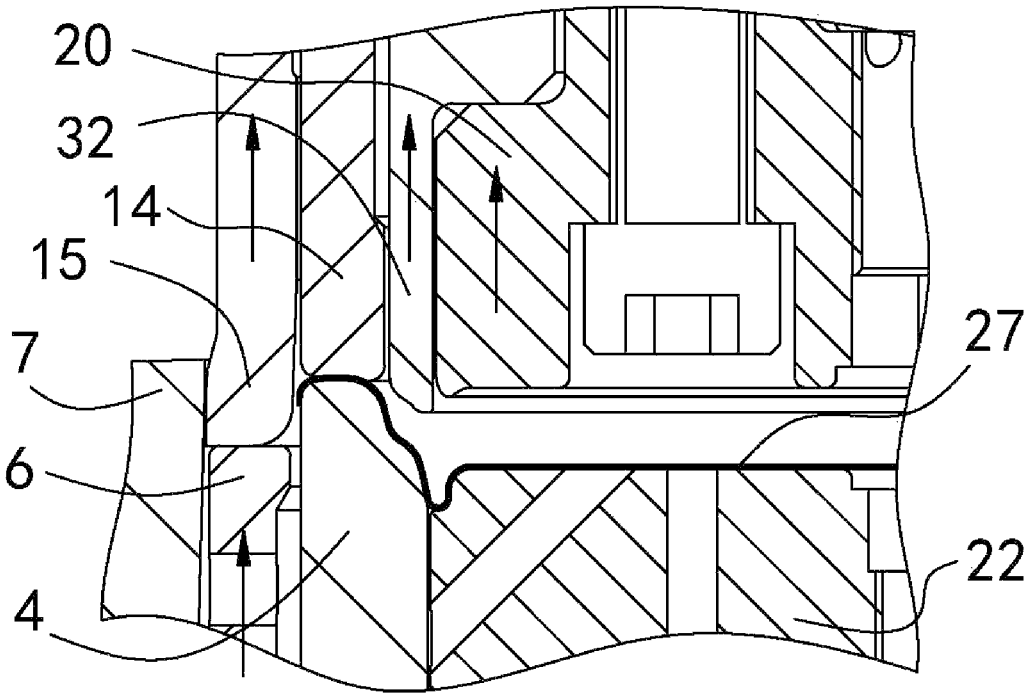
FIG. 26 is the local enlarged view of pressing process 10 in the embodiment 2 of present invention.
Figure 27:
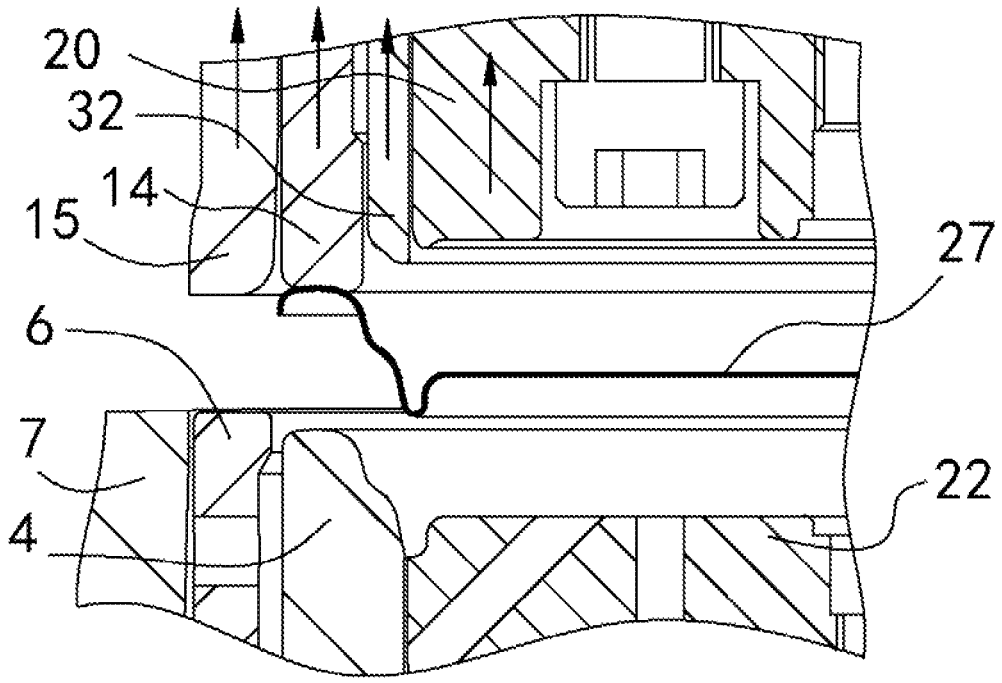
FIG. 27 is the local enlarged view of pressing process 11 in the embodiment 2 of present invention.

However, the bottom of the upper die core body 20 in the embodiment 2 is equipped with a downward raised R fillet at the edge (see FIG. 17), that is, the upper die core body 20 is provided with a contour on its bottom corresponding to the eighth arc portion R8 of the uncurled shell, while the parts at the bottom of the upper die core body 20 corresponding to the seventh arc portion R7 and the fourth straight portion L4 of the uncurled shell are suspended relative to the top of the lower die core body 22 in a closed state.

The other structures of the embodiment 2 are the same as that in the embodiment 1, and will not be described repeatedly.

The pressing forming process of the uncurled shell in the embodiment 2 is shown in FIGS. 17 to 27. The whole pressing forming process is similar to the embodiment 1, but there are differences in the forming method. The embodiment 1 is the forming method without pre-formed uncurled shell, while the embodiment 2 is the forming method with pre-formed uncurled shell.

More detailed information can be obtained by comparing the pressing forming process drawings of the two embodiments, which will not be described in detail here.

Compared with the forming method without pre-formed uncurled shell in the embodiment 1, the forming method with pre-formed uncurled shell in the embodiment 2 has the following advantages:

1. The working pressure of the upper outer forming ring 14 is 30-60 psi, and the working pressure of the upper inner forming ring 32 is 100-130 psi.

During the pre-forming process and in the pressing forming process 5 (FIG. 21 in the embodiment 2 and FIG. 9 in the embodiment 1), the upper outer forming ring 14 and the lower die core ring 4 clamp the outer ring on the uncurled shell blank, while the annular bevel of the bottom end face of the upper inner forming ring 32 contacts the uncurled shell blank and has not yet clamped the middle ring on the uncurled shell blank with the lower die core ring 4.

During the pre-forming process, only the upper outer forming ring 14 compresses the uncurled shell blank, while the upper inner forming ring 32 does not compress the uncurled shell blank. In this state, the material fluidity of the uncurled shell blank is good, so the uncurled shell blank will not become thin during the pre-forming process of the pressing forming process 5.

2. During the pressing forming process 6 (FIG. 22 in the embodiment 2 and FIG. 10 in the embodiment 1), at this point, both the upper forming ring 14 and the upper inner forming ring 32 compress the uncurled shell blank. In this state, the material fluidity of the uncurled shell blank is poor, and there will be slight thinning of the uncurled shell blank during the forming process.

By adding the pre-forming process, the pre-forming is advanced during the pressing forming process 5, so the forming process of the pressing forming process 6 is reduced to improve the thinning of the uncurled shell blanket.

3. During the pressing forming process 7 (FIG. 23 in the embodiment 2 and FIG. 11 in the embodiment 1), the uncurled shell blank begins to be formed in reverse. If a structure without pre-forming is used, during the initial stage of reverse forming of the uncurled shell blank, the uncurled shell blank will exert a significant upward thrust on the upper inner forming ring 32.

In order to ensure the stability of the entire forming process, the air pressure acting on the upper inner forming ring 32 shall always be available to make the upper inner forming 32 compress the uncurled shell blank, so a large amount of air pressure needs to be applied to the upper inner forming ring 32.

If a pre-formed structure is used, when the uncurled shell blank starts reverse forming, a part of ferrule has been pre-formed. Throughout the entire reverse forming process, the uncurled shell blank will not exert significant upward thrust on the upper inner forming ring 32. Therefore, compared to the structure without pre-forming, the working pressure of the upper inner forming ring 32 with pre-formed structure is lower, and the lower working pressure can improve the thinning of the uncurled shell blank and increase the service life of the parts.

4. If a structure without pre-forming is used, during the reverse forming process of the uncurled shell blank, a small bending R fillet (R angular radius less than 0.25 mm) will be formed, ultimately causing slight cracks on the surface of the local area of the fourth straight portion L4 of the uncurled shell of the easy open end, thereby affecting the performance of the uncurled shell of the easy open end.

For the pre-formed structure, the size of the initial bending R fillet during the reverse forming of the uncurled shell blanket can be set by the size of the R angle of the bottom end face of the upper die core body 20, in order to control the minimum bending R angle formed during the reverse forming of the uncurled shell blank, and ensure that the minimum bending R angular radius is greater than or equal to 0.25 mm, to solve the problem of slight cracks on the surface of the local area of the fourth straight portion L4 of the uncurled shell of the easy open end.

It should be noted that the above-described embodiments are only for illustration of technical concept and characteristics of present invention with purpose of making those skilled in the art understand the present invention, and thus these embodiments shall not limit the protection range of present invention.

The equivalent changes or modifications according to spiritual essence of present invention shall fall in the protection scope of present invention.

The invention claimed is:

1. A pressing die for an uncurled shell of a pressure-resistant easy open end, the uncurled shell comprising a sealing portion, a countersink portion, a ferrule arc portion, an upward extension portion of ferrule and a center panel; a first annular recess being formed between the countersink portion, the ferrule arc portion and the upward extension portion of ferrule; the sealing portion being formed by a first straight portion, a first arc portion, a second arc portion, and a third arc portion; the countersink portion being formed by a second straight portion, a fourth arc portion, a fifth arc portion, a sixth arc portion and a third straight portion: the ferrule arc section being formed of a seventh arc portion: the upward extension portion of ferrule being formed a fourth straight line and an eighth arc portion; and the center panel being formed by a fifth straight line; the pressing die comprising a lower die and an upper die; wherein:

the lower die comprises a lower die base, a lower die core ring, a lower die core, a lower pressing ring, and a lower blade, wherein:

the lower die base is a cylinder with an upper opening;

the lower die core ring is fixed in the lower die base and concentric with the lower die base;

an acting part of the lower die core is a cylindrical body, which is embedded in the lower die core ring and slidably matched with the lower die core ring in upward and downward directions;

a first air chamber is sealed and formed under the lower die core in the lower die core ring, and air pressure of the first air chamber supports the lower die core;

the lower pressing ring is embedded between the lower die base and the lower die core ring, and a second air chamber is sealed and formed between the lower die base and the lower die core ring under the lower pressing ring, and air pressure of the second air chamber supports the lower pressing ring; and the lower blade is fixed on an edge of the upper opening of the lower die base, and a lower cutting edge is provided on an inner edge of a top of the lower blade;

the upper die comprises an upper die base, an upper die core, an upper inner forming ring, an upper outer forming ring and an upper blade, wherein:

the upper die base is a cylinder with a lower opening;

an acting part of the upper die core is a cylindrical body, which is arranged in the upper die base and concentric with the upper die base, and the upper die core is slidably matched with the upper die base in the upward and downward directions;

a third air chamber is sealed and formed above the upper die core in the upper die base, and air pressure of the third air chamber presses against the upper die core;

the upper inner forming ring is embedded between the upper die core and the upper die base, and a fourth air chamber is sealed and formed between the upper die core and the upper die base and above the upper inner forming ring, and air pressure of the fourth air chamber presses against the upper inner forming ring;

the upper outer forming ring is an embedded between the upper die base and the upper inner forming ring, and a fifth air chamber is sealed and formed between the upper die base and the upper inner forming ring and above the upper outer forming ring, and air pressure of the fifth air chamber presses against the upper outer forming ring; and the upper blade is fixed on an edge of the lower opening of the upper die base, and an upper cutting edge matched with the lower cutting edge is provided on an outer edge of a bottom of the upper blade;

wherein:

the upper outer forming ring and the upper inner forming ring of the upper die match with the lower die core ring of the lower die, wherein a top of the lower die core ring is provided with a contour corresponding to the first straight portion, the first arc portion, the second arc portion, the third arc portion, the second straight portion, the fourth arc portion, the fifth arc portion, the sixth arc portion and the third straight portion of the uncurled shell;

an annular depression is formed at a top of the lower die core ring, the annular depression corresponding to the second straight portion, the fourth arc portion, the fifth arc portion and sixth arc portion of the uncurled shell;

a bottom of the upper outer forming ring is provided with a contour corresponding to the second arc portion of the uncurled shell, and parts at the bottom of the upper outer forming ring corresponding to the first arc portion and the third arc portion of the uncurled shell are suspended relative to the top of the lower die core ring in a closed state;

a bottom of the upper inner forming ring is provided with a contour corresponding to the fourth arc portion and the fifth arc portion of the uncurled shell, and parts at the bottom of the upper inner forming ring corresponding to the second straight portion, the sixth arc portion and third straight portion of the uncurled shell are suspended relative to the top of the lower die core ring in the closed state;

the upper die core of the upper die matches with the lower die core of the lower die, a top of the lower die core is provided with a contour corresponding to the seventh arc portion, the fourth straight portion, the eighth arc portion and the fifth straight portion of the uncurled shell, and a second annular recess is formed on the top of the lower die core corresponding to the seventh arc portion, the fourth straight portion and the eighth arc portion of the uncurled shell;

a bottom of the upper die core is provided with a contour corresponding to the fifth straight portion of the uncurled shell; and the bottom of the upper die core is provided with a downward raised fillet at an edge of the bottom of the upper die core, the raised fillet corresponding to the eighth arc portion of the uncurled shell, and parts at the bottom of the upper die core corresponding to the seventh arc portion and the fourth straight portion of the uncurled shell are suspended relative to the top of the lower die core in the closed state.

* * * * *